US008580471B2

(12) United States Patent
Owada et al.

(10) Patent No.: US 8,580,471 B2
(45) Date of Patent: Nov. 12, 2013

(54) BIO-TONER CONTAINING BIO-RESIN, METHOD FOR MAKING THE SAME, AND METHOD FOR PRINTING WITH BIO-TONER CONTAINING BIO-RESIN

(75) Inventors: Takeshi Owada, Virginia Beach, VA (US); David Urban, Virginia Beach, VA (US)

(73) Assignee: Mitsubishi Kagaku Imaging Corporation, Chesapeake, VA (US)

( * ) Notice: Subject to any disclaimer, the term of this patent is extended or adjusted under 35 U.S.C. 154(b) by 509 days.

(21) Appl. No.: 12/727,858

(22) Filed: Mar. 19, 2010

(65) Prior Publication Data

US 2010/0239969 A1 Sep. 23, 2010

Related U.S. Application Data

(60) Provisional application No. 61/337,687, filed on Feb. 4, 2010, provisional application No. 61/280,104, filed on Oct. 30, 2009, provisional application No. 61/161,588, filed on Mar. 19, 2009.

(51) Int. Cl.
*G03G 9/087* (2006.01)

(52) U.S. Cl.
USPC ..... 430/109.4; 430/108.1; 430/108.7; 430/108.8; 430/109.1

(58) Field of Classification Search
USPC ..... 430/108.1, 108.7, 108.8, 109.1, 109.4
See application file for complete search history.

(56) References Cited

U.S. PATENT DOCUMENTS

| | | | | |
|---|---|---|---|---|
| 2006/0204876 | A1* | 9/2006 | Kaburagi et al. | 430/105 |
| 2007/0248380 | A1 | 10/2007 | Iwamoto et al. | |
| 2008/0096119 | A1* | 4/2008 | Yamamoto et al. | 430/109.4 |
| 2008/0145775 | A1* | 6/2008 | Vijayendran et al. | 430/109.3 |
| 2008/0227002 | A1 | 9/2008 | Moriya et al. | |
| 2008/0268368 | A1* | 10/2008 | Yuasa et al. | 430/137.14 |
| 2009/0035679 | A1* | 2/2009 | Ogawa et al. | 430/106.2 |

FOREIGN PATENT DOCUMENTS

WO WO 2006/102280 * 9/2006

* cited by examiner

*Primary Examiner* — Peter Vajda
(74) *Attorney, Agent, or Firm* — Oblon, Spivak, McClelland, Maier & Neustadt, L.L.P.

(57) ABSTRACT

A bio-toner for use in electrophotographic image forming that contains a bio-resin component that is at least partially derived from a renewable resource is provided. A method of making the bio-toner that contains a bio-resin component for use in electrophotographic image forming is also provided. A method for electrophotographic image formation using the bio-toner that contains a bio-resin is also provided.

56 Claims, 5 Drawing Sheets

| | Resin 1-Bio- Resin | Sp | Resin 2 | Sp | Carbon Black | Ester-Type Wax | CCA | Kneading Barrel Set Temp. (deg-C) | HSC059N | TG-C6020N | FLT-100 | TG-308F | MeOH absorb. | DSC Peak Temp. (deg-C) | ASTM-D6866 | D50 (μm) |
|---|---|---|---|---|---|---|---|---|---|---|---|---|---|---|---|---|
| Ex 1 | HRJ16062-C (100) | 132.4 | NONE | N/A | Mogul-L (8.0) | WE3 (2.5) | E81 (1.5) | 110 | 0.25 | 0.9 | 0.25 | 0.3 | 310nm | 70 | 53% | 8.9 |
| Ex 2 | HRJ16062-C (100) | 132.4 | NONE | N/A | Mogul-L (8.0) | WE3 (2.5) | DLN-32CW (2.0) | 110 | 0.25 | 0.9 | 0.25 | 0.3 | 570nm | 70 | 53% | 8.7 |
| Ex 3 | HRJ16062-C (100) | 132.4 | NONE | N/A | Mogul-L (8.0) | WE3 (2.5) | E84 (2.0) | 110 | 0.25 | 0.9 | 0.25 | 0.3 | 310nm | 70 | 53% | 9.1 |
| Ex 4 | HRJ16062-C (100) | 132.4 | NONE | N/A | Mogul-L (8.0) | WE3 (2.5) | E81 (1.5) | 110 | 0.25 | 0.9 | 0.25 | 0.3 | 310nm | 70 | 53% | 8.9 |
| Ex 5 | HRJ16062-C (70) | 132.4 | MC 400/500 (30) | 127 | Mogul-L (8.0) | WE3 (2.5) | E81 (1.5) | 110 | 0.25 | 0.9 | 0.25 | 0.3 | 310nm | 70 | 37% | 8.8 |
| | | | | | | | | | | | | | | | | |
| C Ex 1 | HRJ16062-B (100) | 128 | NONE | N/A | Mogul-L (8.0) | WE3 (2.5) | E81 (1.5) | 110 | 0.25 | 0.9 | 0.25 | 0.3 | 310nm | 70 | 55% | 9.0 |

FIG. 2A

| | Printer | OPC | Doctor Bar (Ra) | Doctor Blade (gf/mm) | Wiper Blade (gf/mm) | Developer Roller (Resistance M-Ohm) | Bias on Developer Roller Shaft (V) | ID (Zero Pages) | ID (9000 Pages) | BG (Zero Pages) | BG (9000 Pages) | Gloss | Fixing | Offset |
|---|---|---|---|---|---|---|---|---|---|---|---|---|---|---|
| Ex 1 | Lexmark T644 | FGIC T640 MKIPNPE | OEM (1.3 μm) | N/A | FGIC T640WBLADEK (117gf/mm) | OEM (2,200) | -643V | 1.63 | 1.58 | 0.7 | 1.7 | 11.2 | 92% | Slight |
| Ex 2 | Lexmark T644 | FGIC T640 MKIPNPE | OEM (1.3 μm) | N/A | FGIC T640WBLADEK (117gf/mm) | OEM (2,200) | -643V | 1.51 | — | 1.2 | — | 10.7 | 93% | Slight |
| Ex 3 | Lexmark T644 | FGIC T640 MKIPNPE | OEM (1.3 μm) | N/A | FGIC T640WBLADEK (117gf/mm) | OEM (2,200) | -643V | 1.52 | — | 0.8 | — | 11.6 | 90% | Slight |
| Ex 4 | Samsung ML-1710 | OEM | N/A | OEM (175 gf/mm) | N/A | OEM (42) | -345V | 1.33 | — | 2.4 | — | 5.0 | — | None |
| Ex 5 | Lexmark T644 | FGIC T640 MKIPNPE | OEM (1.3 μm) | N/A | FGIC T640WBLADEK (117gf/mm) | OEM (2,200) | -643V | 1.57 | 1.56 | 0.8 | 0.6 | 10.1 | 95% | None |
| | | | | | | | | | | | | | | |
| C Ex 1 | Lexmark T644 | FGIC T640 MKIPNPE | OEM (1.3 μm) | N/A | FGIC T640WBLADEK (117gf/mm) | OEM (2,200) | -643V | 1.65 | — | 0.9 | — | 9.5 | 94% | NG |

FIG. 2B

| | Resin 1 - Bio-Resin | Amount | Sp | Resin 2 - Petroleum | Amount | Sp | Mag powder | Ester-Type Wax | Hydrocarbon-Type Wax | CCA | Cobalt Contents (ppm) | Kneading Barrel Set Temp. (deg-C) | HO5TD | EPT1002 | DLG20A | VP RY200L2 | MeOH Absorb. | DSC Peak Temp. (deg-C) | ASTM-D6866 | D50 (μm) |
|---|---|---|---|---|---|---|---|---|---|---|---|---|---|---|---|---|---|---|---|---|
| | | | | | | | | | | | | | | | | | | | | |
| Ex 1 | HRJ16062-C | 70 | 133 | MC400/500 | 30 | 127 | RH69P (90) | WE3 (2.5) | C5551 (1.5) | TRH (1.0) | 42 | 125 | 0.35 | 0.7 | 0.05 | 1.15 | 578nm | 72 | 42% | 8.3 |
| Ex 2 | HRJ16062-B | 70 | 128 | MC400/500 | 30 | 127 | RH69P (90) | WE3 (2.5) | C5551 (1.5) | TRH (1.0) | — | 125 | 0.35 | 0.7 | 0.05 | 1.15 | 578nm | 72 | — | 8.2 |
| Ex 3 | HRJ16062-C | 70 | 135 | MC400/500 | 30 | 127 | RH69P (90) | WE3 (2.5) | C5551 (1.5) | TRH (1.0) | — | 125 | 0.35 | 0.7 | 0.05 | 1.15 | 578nm | 72 | — | 8.4 |
| Ex 4 | HRJ16062-D | 70 | 140 | MC400/500 | 30 | 127 | RH69P (90) | WE3 (2.5) | C5551 (1.5) | TRH (1.0) | — | 125 | 0.35 | 0.7 | 0.05 | 1.15 | 578nm | 72 | — | 8.4 |
| Ex 5 | HRJ16062-B | 40 | 128 | MC400/500 | 60 | 127 | RH69P (90) | WE3 (2.5) | C5551 (1.5) | TRH (1.0) | — | 125 | 0.35 | 0.7 | 0.05 | 1.15 | 578nm | 72 | — | 8.3 |
| Ex 6 | HRJ16062-B | 7 | 128 | MC400/500 | 93 | 127 | RH69P (90) | WE3 (2.5) | C5551 (1.5) | TRH (1.0) | — | 125 | 0.35 | 0.7 | 0.05 | 1.15 | 578nm | 72 | — | 8.1 |
| Ex 7 | HRJ16062-C | 70 | 133 | MC400/500 | 30 | 127 | RH69P (90) | WE3 (2.5) | C5551 (1.5) | TRH (1.0) | 42 | 125 | 0.35 | 0.7 | 0.05 | 1.15 | 578nm | 72 | 42% | 8.3 |
| Ex 8 | HRJ16062-C | 70 | 133 | MC400/500 | 30 | 127 | RH69P (90) | WE3 (2.5) | C5551 (1.5) | TRH (1.0) | 42 | 125 | 0.35 | 0.7 | 0.05 | 1.15 | 578nm | 72 | 42% | 8.3 |
| Ex 9 | HRJ16062-C | 70 | 133 | MC400/500 | 30 | 127 | RH69P (90) | WE3 (2.5) | C5551 (1.5) | TRH (1.0) | 42 | 125 | 0.35 | 0.7 | 0.05 | 1.15 | 578nm | 72 | 42% | 8.3 |
| Ex 10 | HRJ16062-C | 70 | 135 | MC500 | 30 | 99 | RH69P (90) | WE10 (8) | C5551 (1.5) | TRH (1.0) | — | 130 | 0.35 | 0.7 | 0.05 | 1.15 | 578nm | 71 | — | 8.2 |
| Ex 11 | HRJ16062-C | 70 | 135 | MC500 | 30 | 99 | RH69P (90) | | P110 (10) | TRH (1.0) | 39 | 130 | 0.35 | 0.7 | 0.05 | 1.15 | 578nm | 96 | — | 8.2 |
| | | | | | | | | | | | | | | | | | | | | |
| | | | | | | | | | | | | | | | | | | | | |
| C Ex 1 | HRJ16062-C | 100 | 133 | None | None | n/a | RH69P (90) | WE3 (2.5) | C5551 (1.5) | TRH (1.0) | — | 125 | 0.35 | 0.7 | 0.05 | 1.15 | 578nm | 72 | 57% | 8.4 |
| C Ex 2 | HRJ16062-B | 100 | 128 | None | None | n/a | RH69P (90) | WE3 (2.5) | C5551 (1.5) | TRH (1.0) | — | 125 | 0.35 | 0.7 | 0.05 | 1.15 | 578nm | 72 | — | 8.2 |
| C Ex 3 | HRJ16062-D | 100 | 140 | None | None | n/a | RH69P (90) | WE3 (2.5) | C5551 (1.5) | TRH (1.0) | — | 125 | 0.35 | 0.7 | 0.05 | 1.15 | 578nm | 72 | — | 8.3 |
| C Ex 4 | HRJ16062-B | 80 | 128 | ET2900 | 20 | 145 | RH69P (90) | WE3 (2.5) | C5551 (1.5) | TRH (1.0) | — | 125 | 0.35 | 0.7 | 0.05 | 1.15 | 578nm | 72 | — | 8.1 |
| C Ex 5 | HRJ16062-C | 70 | 133 | MC400/500 | 30 | 127 | RH69P (90) | WE3 (2.5) | C5551 (1.5) | TRH (1.0) | 42 | 125 | 0.35 | 0.7 | 0.05 | 1.15 | 578nm | 72 | 42% | 8.3 |

FIG. 3A

| | Printer | OPC | DB (gf/mm) | WB (gf/mm) | ID (Zero Pages) | BG (Zero Pages) | Fixing | Offset | Others |
|---|---|---|---|---|---|---|---|---|---|
| | | | 10 ~ 35 | 150 ~ 300 | | | | | |
| Ex 1 | HP4250 | FGIC HP4200MKILPNPE | OEM (20.6) | OEM (235) | 1.56 | 1.23 | 95% | None | OK |
| Ex 2 | HP4250 | FGIC HP4200MKILPNPE | OEM (20.6) | OEM (235) | 1.5 | 0.96 | 95% | None | OK |
| Ex 3 | HP4250 | FGIC HP4200MKILPNPE | OEM (20.6) | OEM (235) | 1.53 | 1.11 | 92% | None | OK |
| Ex 4 | HP4250 | FGIC HP4200MKILPNPE | OEM (20.6) | OEM (235) | 1.48 | 1.25 | 89% | None | OK |
| Ex 5 | HP4250 | FGIC HP4200MKILPNPE | OEM (20.6) | OEM (235) | 1.49 | 0.72 | 95% | None | OK |
| Ex 6 | HP4250 | FGIC HP4200MKILPNPE | OEM (20.6) | OEM (235) | 1.47 | 0.61 | 98% | None | OK |
| Ex 7 | HP P2015 | FGIC HP1160MKIHDPNPE | OEM (23.0) | OEM (253) | 1.42 | 0.51 | 94% | None | OK |
| Ex 8 | HP1012 | FGIC HP1012MKIPNPE | OEM (18.5) | OEM (215) | 1.45 | 0.91 | 96% | None | OK |
| Ex 9 | HP4250 | FGIC HP4200MKILPNPE | Kuroki (24.5) | Kuroki (241) | 1.56 | 0.78 | 95% | None | OK |
| Ex 10 | HP4250 | FGIC HP4200MKILPNPE | OEM (18.5) | OEM (215) | 1.57 | 0.85 | 98 % | None | OK |
| Ex 11 | HP4250 | FGIC HP4200MKILPNPE | OEM (18.5) | OEM (215) | 1.54 | 0.78 | 98 % | None | OK |
| | | | | | | | | | |
| | | | | | | | | | |
| C Ex 1 | HP4250 | FGIC HP4200MKILPNPE | OEM (20.6) | OEM (235) | 1.56 | 1.15 | 78 % | None | OK |
| C Ex 2 | HP4250 | FGIC HP4200MKILPNPE | OEM (20.6) | OEM (235) | 1.51 | 1.12 | 88 % | NG | OK |
| C Ex 3 | HP4250 | FGIC HP4200MKILPNPE | OEM (20.6) | OEM (235) | 1.59 | 1.07 | 52% | None | OK |
| C Ex 4 | HP4250 | FGIC HP4200MKILPNPE | OEM (20.6) | OEM (235) | 1.51 | 0.82 | 72% | None | OK |
| C Ex 5 | HP4250 | FGIC HP4200MKILPNPE | OEM (20.6) | Trial (125) | N/A | N/A | N/A | N/A | Flipping |

FIG. 3B

BIO-TONER CONTAINING BIO-RESIN, METHOD FOR MAKING THE SAME, AND METHOD FOR PRINTING WITH BIO-TONER CONTAINING BIO-RESIN

CROSS REFERENCE TO RELATED APPLICATIONS

This application is related to U.S. provisional patent application Ser. No. 61/161,588, filed Mar. 19, 2009, which is incorporated herein by reference in its entirety. This application is also related to U.S. provisional patent application Ser. No. 61/280,104, filed Oct. 30, 2009, which is incorporated herein by reference in its entirety. This application is also related to U.S. provisional patent application Ser. No. 61/337,687, filed Feb. 4, 2010, which is incorporated herein by reference in its entirety.

BACKGROUND a. Field

The disclosure relates to toner for use in electrophotographic image forming, such as copying and printing. The disclosure further relates to methods of making toner for use in electrophotographic image forming and methods for electrophotographic image formation using toner.

b. Description of the Related Art

Printing and copying processes are widely used to reproduce and disseminate, for example, legal documents, news documents, and correspondence between parties. Conventional printing and copying processes affix an image representing characters of a written language or pictures onto a substrate such as a sheet of paper. Most modern electrophotographic printing and copying processes use a toner to form the images that appear on a document. The toner is most often darkly colored, e.g., black, to show on a white or light background.

In general, toners provide only a temporary image, for example, many copied and/or printed documents are only read or viewed a few times and then discarded. Likewise, most copied documents are stored for only short periods of time before they are discarded. Discarded documents containing toner-based images are usually permanently destroyed through processes such as biodegradation, burning, or recycling.

Recycling is commonly used to reuse the substrate upon which an image is formed. There is no widespread recycling of toners from printed images. Toners on the other hand often undergo chemical and/or physical changes during the image formation process making recycling economically viable only in rare cases. The amount of toner needed to form a single letter-size image is almost insignificant in comparison to the mass of the substrate, e.g., less than 0.1 gram for a letter-sized image. However, the cumulative amount of toner used annually on a worldwide basis is substantial.

Most conventional toners contain one or more thermoplastic components. Typically, the thermoplastic components include a synthetic polymer such as, for example, a polyester. Most polyesters are synthetic, e.g., manufactured from refined materials. The monomers used to make the polyester resins used in toners are almost universally derived from mineral oil sources and are thus referred to as petroleum-based or synthetic monomers. Most mineral oils are thought to be fossilized plant and animal organisms but are not biologically-based or characterized as renewable resources.

There is a trend in developed countries to utilizing renewable resources as components that are consumed in business processes. For example, certain biologically derived polymers, such as cellulose-based polymers, have been suggested as substitutes for the petroleum-based polymeric materials conventionally used in toners.

Because toners are used in such great quantities worldwide, the substitution of synthetic petroleum-based polymers for biologically derived thermoplastics may provide a way to substantially reduce the use of petroleum resources and/or other non-renewable resources. Published patent application U.S. 2007/0015075 (incorporated herein by reference in its entirety) discloses deinkable toner compositions that include biologically-derived components. Deinkable toners are described that contain a thermoplastic polymer and a protein material, each of which is made from at least partially naturally-derived renewable sources such as soybeans. The naturally-derived thermoplastic polymers are made by reacting a soybeans-derived dimer acid with a synthetic diol component to form a polyester-type thermoplastic material. The thermoplastic polymer may contain other biologically-derived components, e.g., monomer units, such as amino acids, in addition to the biologically derived di-acid and/or diol.

Published patent application U.S. 2008/0227002 (incorporated herein by reference in its entirety) discloses toners that include polyester resins. The polyester resins may contain biologically derived di-acid monomer units such as lactic acid.

Published patent application U.S. 2008/0145775 (incorporated herein by reference in its entirety) describes thermoplastic resins synthesized from bio-based materials. The resins may include one or more bio-based monomers that increase the content of the renewable resource materials from which the toner is made.

The inclusion of bio-based components, such as bio-based monomer units, in the thermoplastic resins used in toners is often hindered by difficulties associated with purity, stability, and cost of bio-derived materials. For example, thermoplastic resins made from one or more biologically derived monomer units may suffer from variances in physical properties that are related to the purity and/or physical properties of the biologically-derived monomer units present in their reacted form in the thermoplastic resin. Thus, conventional bio-based resins toners have so far not been proven to be of practical use and have further not been proven to provide exemplary image forming characteristics.

SUMMARY

The disclosure provides for bio-resin-containing bio-toner for use in electrophotographic image formation, methods of making the bio-resin-containing bio-toner, and methods for electrophotographic image formation using the bio-resin-containing bio-toner. The disclosure further provides a bio-toner that is made from one or more components derived from renewable resources such as bio-mass or plant matter. The disclosure further provides an image formed from a bio-toner that includes one or more bio-resins derived from renewable resources. The disclosure further provides a bio-toner that can include a mixture of resins that contains both a bio-resin made from monomer units obtained from a renewable resource and a synthetic resin made from monomer units obtained from petroleum such as mineral oil. The disclosure further provides a composition that can include a mixture of a bio-resin-containing monomer units derived from at least one renewable resource and a synthetic resin derived from one or more petroleum-based sources. The disclosure further provides a bio-toner that can include at least one bio-resin that is a polyester having reacted monomer units of a diol that is derived from a renewable resource. The disclosure further provides a bio-toner that can include at least one bio-resin that is a polyester having reacted monomer units of a diol that is derived from a renewable resource and reacted units of a di-acid that is derived from a renewable resource. The disclosure further provides a bio-toner that can include at least one bio-resin that is a polyester having reacted monomer units of an isosorbide, reacted units of Floradyme 1100, reacted units of Pripol 1013, reacted units of CHDA, and reacted units of trimethylolpropane (TMP). The disclosure further provides a method for image forming that includes electrostatically forming an image with a bio-toner that includes a bio-resin and transferring the image onto a substrate.

There is provided in one embodiment a bio-toner comprising a bio-resin, a second resin, and one or more colorants. The bio-resin is preferably a polyester polymer comprising one or more reacted di-acid monomer units and one or more reacted diol monomer units. Preferably, at least one of the reacted di-acid monomer units or at least one of the reacted diol monomer units is a bio-monomer obtained from a plant or an animal source.

There is provided in another embodiment a bio-toner comprising a bio-resin, a second resin, a wax, and one or more colorants. The bio-resin is preferably a polyester polymer comprising one or more reacted di-acid monomer units and one or more reacted diol monomer units. Preferably, at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin.

There is provided in another embodiment a bio-toner comprising a bio-resin, a second resin, a wax, and one or more colorants. The bio-resin is preferably a polyester polymer comprising reacted di-acid monomer units and reacted diol monomer units. Preferably, at least 50 mol % of at least one of the diol monomer units and the di-acid monomer units are bio-monomers obtained from a plant or animal source, where mol % is based on the total number of mols of the diol monomer units or the di-acid monomer units, respectively.

There is provided in another embodiment a bio-toner comprising a bio-resin, one or more colorants, and 0% to about 30% by weight of a magnetic component, based on a total weight of the bio-resin, the one or more colorants, and the magnetic component, if present. The bio-resin is preferably a polyester polymer comprising one or more reacted di-acid monomer units and one or more reacted diol monomer units. Preferably, at least one of the reacted di-acid monomer units or at least one of the reacted diol monomer units is a bio-monomer obtained from a plant or an animal source.

There is provided in another embodiment a method of making a bio-toner comprising mixing a bio-resin, a second resin, and one or more colorants in a mixing apparatus to form a bio-resin mixture. The method further comprises the step of kneading the bio-resin mixture in an extruder apparatus to form an extruded bio-resin mixture. The method further comprises pulverizing the extruded bio-resin mixture in a pulverizing apparatus to form a pulverized bio-resin mixture. The method further comprises classifying the pulverized bio-resin mixture to obtain a classified bio-resin mixture. The method further comprises adding one or more additives to the classified bio-resin mixture to form the bio-toner. The bio-resin is preferably a polyester polymer comprising one or more reacted di-acid monomer units and one or more reacted diol monomer units. Preferably, at least one of the reacted di-acid monomer units or at least one of the reacted diol monomer units is a bio-monomer obtained from a plant or an animal source.

There is provided in another embodiment a method of making a bio-toner comprising mixing a bio-resin, a second resin, a wax, and one or more colorants in a mixing apparatus to form a bio-resin mixture. The method further comprises kneading the bio-resin mixture in an extruder apparatus to form an extruded bio-resin mixture. The method further comprises pulverizing the extruded bio-resin mixture in a pulverizing apparatus to form a pulverized bio-resin mixture. The method further comprises classifying the pulverized bio-resin mixture to obtain a classified bio-resin mixture. The method further comprises adding one or more additives to the classified bio-resin mixture to form the bio-toner. The bio-resin is preferably a polyester polymer comprising one or more reacted di-acid monomer units and one or more reacted diol monomer units. Preferably, at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin.

There is provided in another embodiment a method of making a bio-toner comprising mixing a bio-resin, one or more colorants, and 0% to about 30% by weight of a magnetic component, based on a total weight of the bio-resin, the one or more colorants, and the magnetic component, if present. The method further comprises kneading the bio-resin mixture in an extruder apparatus to form an extruded bio-resin mixture. The method further comprises pulverizing the extruded bio-resin mixture in a pulverizing apparatus to form a pulverized bio-resin mixture. The method further comprises classifying the pulverized bio-resin mixture to obtain a classified bio-resin mixture. The method further comprises adding one or more additives to the classified bio-resin mixture to form the bio-toner. The bio-resin is preferably a polyester polymer comprising one or more reacted di-acid monomer units and one or more reacted diol monomer units. Preferably, at least one of the reacted di-acid monomer units or at least one of the reacted diol monomer units is a bio-monomer obtained from a plant or an animal source.

There is provided in another embodiment a method of forming an image. The method comprises depositing a bio-toner comprising a bio-resin, a second resin, and one or more colorants, on an outer circumferential surface of an axially rotating developing sleeve to form a bio-toner covered developing sleeve. The method further comprises distributing the bio-toner over the circumferential surface of the bio-toner covered developing sleeve by contacting or placing in proximity thereto, the bio-toner present on the bio-toner covered developing sleeve with a doctor blade or doctor bar evenly spaced from the circumferential surface and across the width of the circumferential surface of the developing sleeve. The method further comprises contacting or placing in proximity thereto, the bio-toner present on the circumferential surface of the bio-toner covered developing sleeve with a photoconductive surface having a latent image formed by electrostatically charging the photoconductive surface to form a bio-toner image on the photoconductive surface. The method further comprises transferring the bio-toner image from the photoconductive surface to a substrate to form a printed image and fusing the printed image onto the substrate. The method further comprises cleaning the surface of the photoconductive surface with a wiper blade to remove a bio-toner residue.

There is provided in another embodiment a method of forming an image. The method comprises depositing a bio-toner comprising a bio-resin, a second resin, a wax, and one or more colorants, on an outer circumferential surface of an axially rotating developing sleeve to form a bio-toner covered developing sleeve. The method further comprises distributing the bio-toner over the circumferential surface of the bio-toner covered developing sleeve by contacting or placing in proximity thereto, the bio-toner present on the bio-toner covered developing sleeve with a doctor blade evenly spaced from the circumferential surface and across the width of the circumferential surface of the developing sleeve. The method further comprises contacting or placing in proximity thereto, the bio-toner present on the circumferential surface of the bio-toner covered developing sleeve with a photoconductive surface having a latent image formed by electrostatically charging the photoconductive surface to form a bio-toner image on the photoconductive surface. The method further comprises transferring the bio-toner image from the photoconductive surface to a substrate to form a printed image and fusing the printed image onto the substrate. The method further comprises cleaning the surface of the photoconductive surface with a wiper blade to remove a bio-toner residue.

There if provided in another embodiment a method of forming an image. The method comprises depositing a bio-toner comprising a bio-resin, one or more colorants, and 0% to about 30% by weight of a magnetic component, based on a total weight of the bio-resin, the one or more colorants, and the magnetic component, if present, on an outer circumferential surface of an axially rotating developing sleeve to form a bio-toner covered developing sleeve. The method further comprises distributing the bio-toner over the circumferential surface of the bio-toner covered developing sleeve by contacting or placing in proximity thereto, the bio-toner present on the bio-toner covered developing sleeve with a doctor blade or doctor bar evenly spaced from the circumferential surface and across the width of the circumferential surface of the developing sleeve. The method further comprises contacting or placing in proximity thereto, the bio-toner present on the circumferential surface of the bio-toner covered developing sleeve with a photoconductive surface having a latent image formed by electrostatically charging the photoconductive surface to form a bio-toner image on the photoconductive surface. The method further comprises transferring the bio-toner image from the photoconductive surface to a substrate to form a printed image and fusing the printed image onto the substrate. The method further comprises cleaning the surface of the photoconductive surface with a wiper blade to remove a bio-toner residue.

The above description sets forth, rather broadly, a summary of embodiments of the disclosure so that the detailed description that follows may be better understood and contributions of the disclosure to the art may be better appreciated. Some of the disclosed embodiments may not include all of the features or characteristics listed in the above summary. There may be, of course, other features that will be described below and may form the subject matter of claims.

DESCRIPTION OF DRAWINGS

A more complete appreciation of the disclosed embodiments and many of the attendant advantages thereof will be readily obtained as the same becomes better understood by reference to the following detailed description when considered in connection with the accompanying drawings, wherein:

FIG. 2A illustrates a table that shows the compositions of non-magnetic bio-toners for Examples 1-5 and Comparative Example 1;

FIG. 2B illustrates a table that shows the experimental conditions for printing experiments conducted with the non-magnetic bio-toners of Examples 1-5 and Comparative Example 1, and also shows the results of experiments relating to print quality properties using the non-magnetic bio-toners of Examples 1-5 and Comparative Example 1;

FIG. 3A illustrates a table that shows the compositions of magnetic bio-toners for Examples 1-11 and Comparative Examples 1-5; and, FIG. 3B illustrates a table that shows the experimental conditions for printing experiments conducted with the magnetic bio-toners of Examples 1-11 and Comparative Examples 1-5, and also shows the results of experiments relating to print quality properties using the magnetic bio-toners of Examples 1-11 and Comparative Examples 1-5.

DETAILED DESCRIPTION

Figures 1A, 1B:
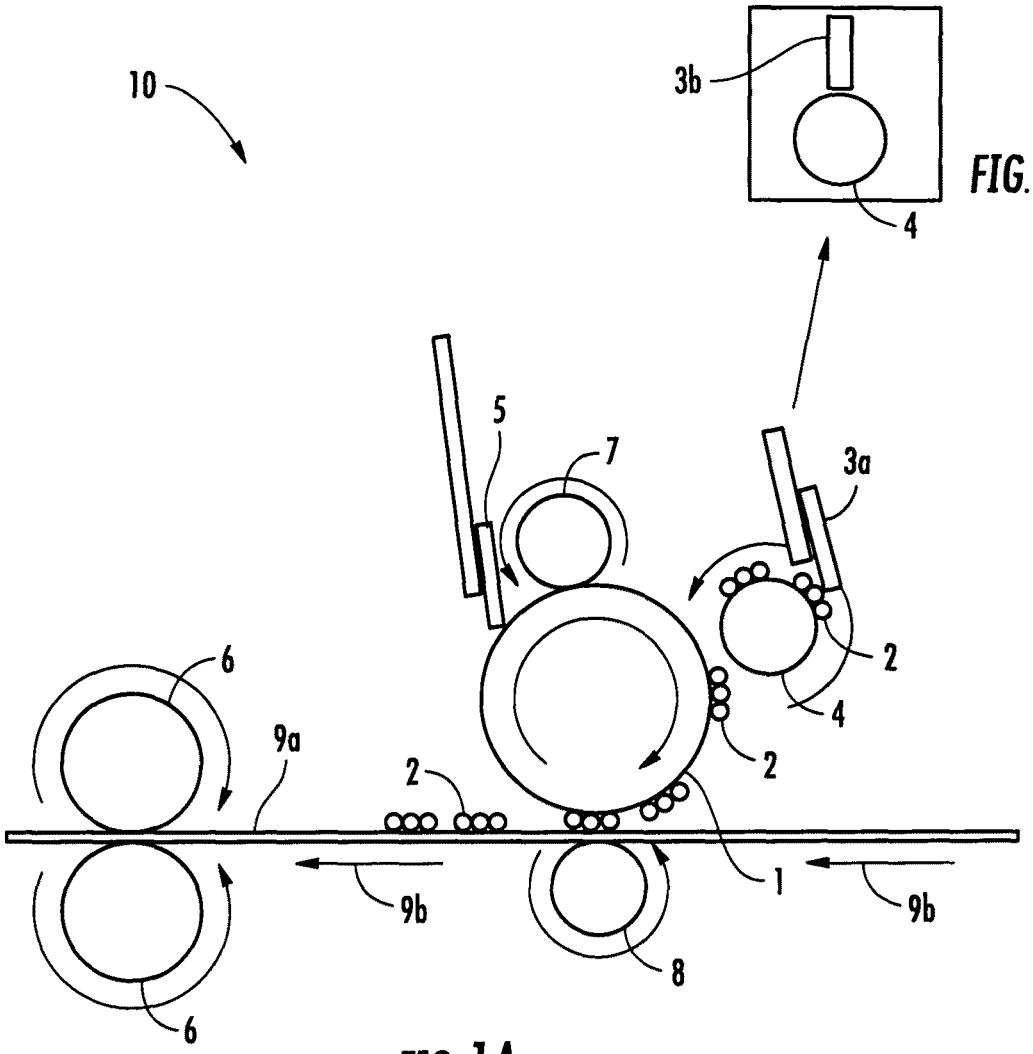
FIG. 1A is a schematic diagram of various internal components of an electrophotographic image forming device for carrying out electrophotographic printing.
FIG. 1B is a schematic diagram of a doctor bar that may be used in place of the doctor blade in the electrophotographic image forming device of FIG. 1A.

Disclosed embodiments will now be described more fully hereinafter. Several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized without departing from the scope of the disclosed embodiments. Also, it is to be understood that the phraseology and terminology employed herein are for the purpose of description and should not be regarded as limiting. The order in which the method steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the disclosed embodiments.

Bio-Resin Monomers—The bio-resin of the bio-toner of the disclosure contains reacted units of at least one monomer unit derived from bio-mass such as plant matter and/or a renewable resource. A monomer unit derived from a renewable resource and/or bio-mass is referred to herein as a bio-monomer. The bio-monomer of the bio-resin is preferably a diol and/or a di-acid, and each may be present as reacted units of a thermoplastic material. The thermoplastic material preferably contains one or more polyester units or one or more polyester polymers. It is particularly preferred that the bio-resin is a thermoplastic polyester polymer that includes both diol bio-monomers and di-acid bio-monomers.

The bio-resin is preferably a polyester polymer comprising one or more reacted di-acid monomer units and one or more reacted diol monomer units. Preferably, at least one of the reacted di-acid monomer units or at least one of the reacted diol monomer units is a bio-monomer obtained from a plant or an animal source. More preferably, at least one of the reacted di-acid monomer units and at least one of the reacted diol monomer units is a bio-monomer obtained from a plant or an animal source. Most preferably, the bio-resin comprises two reacted di-acid monomer units and one reacted diol monomer unit.

The diol bio-monomer units of the bio-resin may be present in an amount of at least about 5% by weight, where % by weight is based on the total weight of all diol monomer units in the bio-resin. Preferably, the diol bio-monomer units of the bio-resin may be present in an amount of at least about 30% by weight; more preferably, the diol bio-monomer units of the bio-resin may be present in an amount of at least about 50% by weight; and most preferably, the diol bio-monomer units of the bio-resin may be present in an amount of at least about 70% by weight.

Preferably, the di-acid bio-monomer units of the bio-resin may be present in an amount of at least about 5% by weight, where % by weight is based on the total weight of all the di-acid monomer units in the bio-resin. More preferably, the di-acid bio-monomer units of the bio-resin may be present in an amount of at least about 10% by weight; and most preferably, the di-acid bio-monomer units of the bio-resin may be present in an amount of at least about 30% by weight.

Preferably, at least about 5% by weight of at least one of the di-acid monomer units or at least one of the diol monomer units are bio-monomers obtained from a plant or an animal source, where percent by weight is based on the total percent by weight of the diol monomer units and the di-acid monomer units in the bio-resin. More preferably, at least about 5% by weight of at least one of the di-acid monomer units and at least one of the diol monomer units are bio-monomers obtained from a plant or an animal source, where percent by weight is based on the total percent by weight of the diol monomer units and the di-acid monomer units in the bio-resin. Even more preferably, for non-magnetic bio-toner embodiments, at least a 57% by weight of at least one of the di-acid monomer units or at least one of the diol monomer units are bio-monomers obtained from a plant or an animal source, and even more preferably, for non-magnetic bio-toner embodiments, at least a 57% by weight of at least one of the di-acid monomer units and at least one of the diol monomer units are bio-monomers obtained from a plant or an animal source, where percent by weight is based on the total percent by weight of the diol monomer units and the di-acid monomer units in the bio-resin. Even more preferably, for magnetic bio-toner embodiments, at least a 50% by weight of at least one of the di-acid monomer units or at least one of the diol monomer units are bio-monomers obtained from a plant or an animal source, and even more preferably for magnetic bio-toner embodiments, at least a 50% by weight of at least one of the di-acid monomer units and at least one of the diol monomer units are bio-monomers obtained from a plant or an animal source, where percent by weight is based on the total percent by weight of the diol monomer units and the di-acid monomer units in the bio-resin.

The bio-resin may also consist essentially of bio-monomer units such that, (i) the suitability of the bio-resin for recycling and/or bio-degradation is not impaired, and/or (ii) the image forming properties of a bio-toner containing the bio-resin are not impaired (e.g., impairment is a greater than 5% change in comparison to the properties of the bio-resin which consists of the same bio-monomer units).

The polyester bio-resin or polyester units present in a bio-resin co-polymer may contain both diol bio-monomer units and di-acid bio-monomer units and, optionally, bio-crosslinking monomer units. For example, the bio-resin may contain blocks of a polyester polymer or polyester units in addition to blocks of a different polymer, e.g., a polystyrene, polyethylene, and/or polypropylene resin.

In one embodiment of the disclosure, the bio-toner contains one or more components that consist of bio-derived building blocks such as bio-monomers. In addition, any other components present in the bio-toner are likewise preferred to be derived mainly or only from renewable resources. Thus, the bio-toner may include a wax that is derived from a plant source such as candelilla wax, jojoba oil, and/or soybean-derived materials. The total amount of components derived from bio-sources and/or renewable resources includes any material present in the bio-toner prior to and/or after carrying out image formation using the bio-toner of the disclosure.

Diol—The diol monomer units may be one or more bisphenol-A alkylene oxide addition products. The bisphenol-A alkylene oxide addition products may preferably comprise one or more of polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene (2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A.

Diols and other polyhydric compounds containing from 2 to 10 carbon atoms may be included in the bio-resin, preferably derived from a renewable resource and/or derived from known sources, including glycol ethers or diol ethers having from 4 to 12 carbon atoms. Suitable glycols, in addition to ethylene glycol and 1,4-cyclohexanedimethanol (CHDM), include diethylene glycol, propylene glycol (1,2-propane diol), 1,3-propanediol, 2-methyl-1,3-propanediol, 2,2-dimethyl-1,3-propanediol (neopentyl glycol), 1,2-butanediol, 1,4-butanediol, pentaerythritol, similar glycols and diols, and mixtures thereof.

Diol compounds may further include cycloaliphatic diols having 6 to 20 carbon atoms or aliphatic diols preferably having 3 to 20 carbon atoms. Examples include diethylene glycol, triethylene glycol, propylene glycol, 1,4-cyclohexanedimethanol, propane-1,3-diol, butane-1,4-diol, pentane-1,5-diol, hexane-1,6-diol, hexane-1,4-diol, 1,4-cyclohexanedimethanol, 3-methylpentanediol-(2,4), 2-methylpentanediol-(1,4), 2,2,4-trimethylpentane-diol-(1,3), 2-ethylhexanediol-(1,3), 2,2-diethylpropane-diol-(1,3), hexanediol-(1,3), 1,4-di-(hydroxyethoxy)-benzene, 2,2-bis-(4-hydroxycyclohexyl)-propane, 2,4-dihydroxy-1,1,3,3-tetra-methyl-cyclobutane, 2,2-bis-(3-hydroxyethoxyphenyl)-propane, neopentyl glycol, 2,2-bis-(4-hydroxypropoxyphenyl)-propane, mixtures thereof, and the like. Polyesters may be prepared from two or more of the above diols.

Trihydric or higher alcohol components may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

In a particularly preferred embodiment of the disclosure, the bio-resin includes a trihydric monomer, e.g., a triol. Preferably, the triol is present in an amount of from about 0.1% by weight to about 5% by weight based on the total weight of the polyester portion of the bio-resin. In other disclosed embodiments, the triol is present in an amount of from about 0.5% by weight to about 4.5% by weight, about 1.0% by weight to about 4.0% by weight, about 1.5% by weight to about 3.5% by weight, about 2.0% by weight to about 3.0% by weight, and/or about 2.5% by weight. The triol serves to provide crosslinking in the bio-resin. The crosslinking is preferably effective to provide a bio-resin that has improved hardness and toughness capabilities when used in the bio-toner without sacrificing fusing and/or offset performance. The triol may be derived from natural and/or renewable resources other than petroleum resources in the same manner as the diol and di-acid bio-monomers. A preferred triol is trimethylolpropane (TMP).

The preferred diol is a bio-based material obtained from one or more renewable resources such as a corn feedstock. Glycerol is one example of a polyol that may be used as a diol in the bio-resin of the disclosure. Glycerol may be obtained from fatty acids and/or oils such as the vegetable oil commonly used in frying foods. Gylcerol is preferably obtained from a source that converts waste food oil to bio-diesel. In another preferred embodiment, the diol is ethylene glycol.

In a particularly preferred embodiment of the disclosure, the diol bio-monomer is an isosorbide (e.g., a dianhydrohexitol), and/or an isomer or derivative thereof, including (1,4:3,6-dianhydro-D-glucitol), or isomers thereof and/or mixtures of isomers, including D-isosorbide, and 1,4:3,6-dianhydro-D-mannitol and 1,4:3,6-dianhydro-D-iditol are isomers of isosorbide. When the diol is isosorbide, it is preferably present as a majority of all diol units, i.e., at least 50 wt % of the diol monomer units are isosorbide monomer units. In other embodiments, the isosorbide may be present in an amount of at least 55 wt %, at least 60 wt %, at least 65 wt %, at least 70 wt %, at least 75 wt %, at least 80 wt %, at least 85 wt %, or at least 90 wt %, of the total weight of all of the diol monomers present in the bio-resin.

Carboxylic acid—The dicarboxylic acid monomer unit includes both aromatic dicarboxylic acids and aliphatic dicarboxylic acids. Preferably, the di-acid monomer unit of the polyester bio-resin is one or more of phthalic acid, isophthalic acid, and terephthalic acid, or anhydrides thereof, or esters thereof; alkyldicarboxylic acids such as succinic acid, adipic acid, sebacic acid and azelaic acid, or anhydrides thereof or esters thereof; succinic acids substituted with an alkyl group having 6 to 12 carbon atoms, or anhydrides thereof; and unsaturated dicarboxylic acids such as fumaric acid, maleic acid and citraconic acid, or anhydrides thereof or esters thereof. The monomer units are present in the polyester in their reacted form derived by condensation with an alcohol such as a diol, and are not present as the free acid, ester, or anhydride.

In a particularly preferred embodiment, the bio-toner contains a polyester unit having as an alcohol component a bisphenol derivative and a dibasic or higher carboxylic acid or an acid anhydride thereof as an acid component (e.g., fumaric acid, maleic acid, maleic anhydride, phthalic acid, terephthalic acid, trimellitic acid, or pyromellitic acid).

A tricarboxylic acid monomer unit may also be included in the bio-resin of the disclosure. Higher polycarboxylic acid monomer units may also be present in a form condensed with one or more diol monomer units. Preferably, the tri-carboxylic acid and/or polycarboxylic acid monomer units are one or more of 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides or ester compounds of these. The tribasic or higher polycarboxylic acid component may preferably be used in an amount of from about 0.1 wt % to about 1.9 wt % based on the total wt % of the whole monomers.

The di-acid is preferably derived from renewable resources such as vegetable-based raw materials including cotton seed, rapeseed, soybean, tall oil, tallow, and/or other naturally derived or naturally occurring fatty acid sources. Commercially available di-acids are particularly preferred, such as the dimer acid products available from Florachem of Jacksonville, Fla. A preferred commercially available di-acid is Floradyme 1100 which contains about 98% of dimer di-acid material. The Floradyme dimer acid is formed by heating a fatty acid source in the presence of a catalyst and distilling the resulting product. Floradyme 1100 contains a dimer of a $C_{18}$ fatty acid, such as derived from the dimerization of oleic, linoleic, and/or linolenic acid. Other distillates such as Floradyme 1500 and/or Floradyme 6500 which contain a trimer acid di-acid may also be present in the bio-resin of the toner. Another preferred commercially available di-acid is Pripol 1013.

The di-acid used to make the bio-resin of the bio-toner is preferably purified through one or more distillations. The distillation may occur at any point during the production of the di-acid. For example, the fatty acid raw material may be subjected to distillation to provide a pure starting material which may be subjected to dimerization and used as the dimer of the disclosed embodiments without further purification. Preferably, the di-acid is subjected to distillation after dimerization such that lower boiling non-dimerized materials can be efficiently separated from the desired product.

In a preferred embodiment of the disclosure, the bio-resin contains both one or more bio-monomers and one or more petroleum-based monomers. For example, the bio-resin may contain a petroleum monomer, such as 1,4-cyclohexanedicarboxylic acid, and a bio-monomer di-acid, such as Floradyme 1100 and Pripol 1013. The petroleum-based di-acid monomer may be present in an amount of 0% by weight to about 95% by weight, based on the total weight % of all of the di-acid monomer units. The Floradyme di-acid may be present in an amount of about 5% by weight to 100% by weight, based on the total weight % of all of the di-acid monomer units. One or more additional monomer units, such as alcohol-based or acid-based crosslinking monomer unit, may also be present as reacted units in the bio-resin.

Preferably, the bio-resin of the bio-toner of the disclosure comprises a mixture of different di-acid and/or different diol bio-monomer units. For example, the bio-resin may include only one type of diol or one type of di-acid in combination with at least two different types of di-acids or diols, respectively. In preferred embodiments, the bio-resin contains polymerized units of two different di-acids and one or more diols. Such mixtures of di-acids may include, for example, a Floradyme monomer unit such as Floradyme 1100 and 1,4-Cyclohexane-dicarboxylic acid (CHDA). Preferably, the bio-resin is made from a mixture of monomer units that contains at least two different di-acid monomer units and at least one diol monomer unit. Examples of such bio-resins contain, for example, an essentially equimolar number of diol and di-acid monomer units with monomer units present in amounts by weight of about 20% by weight to about 60% by weight CHDA; about 5% by weight to about 40% by weight Floradyme 1100 and/or Pripol 1013; about 20% by weight to about 60% by weight isosorbide; and about 1.5% by weight to about 5.0% by weight of a crosslinking agent such as trimethylolpropane (TMP); where weight % is based on the total weight of all polymerized monomer units, more preferably about 30% by weight to about 50% by weight CHDA; about 10% by weight to about 30% by weight Floradyme 1100 and/or Pripol 1013; about 30% by weight to about 50% by weight isosorbide; and about 2.0% by weight to about 4.0% by weight of a crosslinking agent such as trimethylolpropane (TMP); even more preferably about 35% by weight to about 45% by weight CHDA; about 15% by weight to about 25% by weight Floradyme 1100 and/or Pripol 1013; about 35% by weight to about 45% by weight isosorbide; and about 2.5% by weight to about 3.5% by weight of a crosslinking agent such as trimethylolpropane (TMP). All integer and fractional values between the stated ranges are expressly included herein as if written.

Preferred bio-resins may be obtained from Advanced Image Resources of Alpharetta, Ga. and may include such bio-resins as HRJ 16062-A, B, C, and D.

Two Resin Composition—In a preferred disclosed embodiment, the bio-toner contains at least two different thermoplastic resins, one of which is a bio-resin, the other of which is a second resin derived mainly from petroleum sources, e.g., containing mainly petroleum-based monomers. In this embodiment of the disclosure, the bio-resin is preferably present in a major amount based on the total weight of all of the resins present in the bio-toner. Preferably, the second resin is a polymer comprising one or more petroleum-based monomers. However, the second resin may also comprise a bio-monomer as a minor component. The inclusion of a resin derived from a petroleum source as a minor component in the bio-toner of the disclosure may provide a bio-toner which has improved toughness, offset, and/or fixing properties during and after the image forming process.

In other disclosed embodiments, the bio-toner contains a first bio-resin and a second bio-resin, and optionally, any number of additional resins derived from petroleum and/or renewable sources. In this disclosed embodiment, the mixture of the first bio-resin and the second bio-resin may provide image forming characteristics and physical properties similar to or closely matching the properties obtained from toners containing both a bio-resin and a resin derived from petroleum sources while concurrently increasing the total bio-content of the resin component and/or the bio-toner of the disclosure.

When both bio-resins and second resins such as petroleum resins are present in the bio-toner, the bio-resins are preferably present in an amount in a range of from about 5% by weight to 100% by weight based on the total weight of the bio-resins and the second resins (petroleum resins) present in the bio-toner; more preferably, from about 30% by weight to 100% by weight; and, most preferably from about 50% by weight to 100% by weight. The second resins (petroleum resins) are preferably present in an amount in a range of 0% by weight to about 95% by weight, based on the total weight of the bio-resins and the second resins (petroleum resins) present in the bio-toner.

Softening Point (Sp)—In a particularly preferred embodiment of the disclosure, the bio-toner includes at least two different thermoplastic resins having different softening points. One of the resins is preferably a bio-resin. At least one different second resin, preferably derived from a petroleum-based source (petroleum resin), is likewise present. Preferably, the softening point of the bio-resin is in the range of from about 70° C. (degrees Celsius) to about 170° C. (degrees Celsius). More preferably, the softening point of the bio-resin is in the range of from about 100° C. to about 150° C. Most preferably, the softening point of the bio-resin is in the range of from about 130° C. to about 135° C. The softening point of the second resin is preferably from about 75° C. to about 200° C. More preferably, the softening point of the second resin is preferably in the range of from about 90° C. to about 180° C. Most preferably, the softening point of the second resin is preferably in the range of from about 90° C. to about 140° C. The softening points of the bio-resin and the second resin may take any value within the ranges disclosed herein.

Glass Transition Temperature—The glass transition temperatures (Tg) of the resins in a bio-toner that contains both of at least one bio-resin and at least one second resin are likewise preferably different. The bio-resin present in the bio-toner of the disclosure preferably has a glass transition temperature in a range of from about 45° C. to about 70° C.; more preferably, a glass transition temperature in a range of from about 50° C. to about 65° C.; and even more preferably, a glass transition temperature in the range of from about 55° C. to about 60° C.

ASTM—The content of bio-based materials in the bio-toner of the disclosure and/or any component of the bio-toner of the disclosure is preferably determined according to ASTM D6866-08 "Standard Test Methods for Determining the Biobased Content of Solid, Liquid, and Gaseous Samples Using Radiocarbon Analysis," incorporated herein by reference in its entirety. This method determines the content of bio-based materials according to the content of certain isotopes of carbon ($^{14}C$). For non-magnetic bio-toner embodiments, preferably, the bio-toner of the disclosure has a bio-based content of at least about 5% according to ASTM D6866; more preferably, the bio-toner of the disclosure has a bio-based content of at least about 30% according to ASTM D6866; and most preferably, the bio-toner of the disclosure has a bio-based content of at least about 50% according to ASTM D6866. For magnetic bio-toner embodiments, preferably, the bio-toner of the disclosure has a bio-based content of at least about 10% according to ASTM D6866; more preferably, the bio-toner of the disclosure has a bio-based content of at least about 20% according to ASTM D6866; and, most preferably, the bio-toner of the disclosure has a bio-based content of at least about 30% according to ASTM D6866.

Petroleum Resins—The second resin (petroleum resin) used in combination with the bio-resins may be any resin conventionally used to form toner compositions. Such resins may include styrene acrylate resins and polyesters resins of all types and co-polyester resins. Preferred petroleum resins may include the MC line of resins, such as MC400 and MC500 resins, available from Sanyo Chemical Industries, Ltd. of Japan. The HIMER resin of Sanyo Chemical Industries Ltd. of Japan, which includes styrene-acrylic type toner resin, may also be included. Other preferable commercially available resins may include MC 601 and MC 703 available from Sanyo Chemical Industries Ltd. of Japan and ET2900 available from SK Chemicals Co. Ltd. of Korea.

Other resins may include any one or more of a styrene resin, a saturated or unsaturated polyester resin, an epoxy resin, a polyurethane resin, a vinyl chloride resin, a polyethylene, a polypropylene, an ionomer resin, a silicone resin, a rosin-modified maleic acid resin, a phenol resin, a ketone resin, an ethylene/ethylacrylate copolymer, or a polyvinyl butyral resin, may, for example, be included in the bio-toner. Polyester resins are particularly preferred as additional second resins.

The styrene resin may be a homopolymer or a copolymer containing styrene or a styrene-derivative, such as a polystyrene, a chloropolystyrene, a poly-α-methyl styrene, a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, a styrene/acrylate copolymer, a styrene/acrylate/acrylic acid copolymer, a styrene/acrylate/methacrylic acid copolymer, a styrene/methacrylate copolymer, a styrene/mechacrylate/acrylic acid copolymer, a styrene/methacrylate/methacrylic acid copolymer, a styrene/methyl α-chloroacrylate copolymer, or a styrene/acrylonitrile/acrylate copolymer. It may be their mixture. Here, the ester group for the acrylate or methacrylate is not particularly limited, but may, for example, be a $C_{1-8}$ hydrocarbon ester such as a methyl ester, an ethyl ester, a butyl ester, an octyl ester or a phenyl ester. Further, one having a part or whole of the above acrylic acid or methacrylic acid substituted by a substituted monocarboxylic acid such as α-chloroacrylic acid or α-bromoacrylic acid, an unsaturated dicarboxylic acid such as fumaric acid, maleic acid, maleic anhydride or monobutyl maleate, an anhydride thereof or a half ester thereof, may also be suitably used.

Particularly preferable are second resins selected from the group consisting of a styrene/acrylate copolymer, a styrene/acrylate/acrylic acid copolymer, a styrene/acrylate/methacrylic acid copolymer, a styrene/methacrylate copolymer, a styrene/methacrylate/acrylic acid copolymer and a styrene/methacrylate/methacrylic acid copolymer, since such resins provide excellent fixing, durability, and electrostatic stability.

Further, the glass transition temperature (Tg) of the second resin is preferably at most 80° C., and more preferably at most 70° C., for fixing with a low energy. Further, such Tg is preferably at least 40° C., and more preferably at least 50° C., from the viewpoint of an anti-blocking property. Tg is measured as a temperature at the intersection of two tangent lines when such tangent lines are drawn at the transition (change in curvature) starting portion of the curve measured under a condition of a temperature raising rate of 10° C./minute by a differential scanning calorimeter (DTA-40, manufactured by Shimadzu Corporation of Japan).

In disclosed embodiments, Sp and Tg of the second resin can be adjusted to the above ranges by adjusting the type of the resin and the compositional ratio of monomers, the molecular weight, and the like. Further, it is also possible to properly select and use one having Sp and Tg within the above ranges among commercially available resins.

When styrene/acrylate copolymer or styrene/acrylate/acrylic acid copolymer is used as the second resin, a number average molecular weight by a gel permeation chromatography (hereinafter referred to as GPC) of at least 2,000, more preferably at least 2,500, further preferably at least 3,000 and preferably at most 50,000, more preferably at most 40,000, further preferably at most 35,000 is preferred. Further, such a second resin preferably has a weight average molecular weight obtained in the same manner, of at least 50,000, more preferably at least 100,000, further preferably at least 200,000 and preferably at most 2,000,000, more preferably at most 1,000,000, further preferably at most 500,000. When the number average molecular weight and the weight average molecular weight of the styrene resin are within the above ranges, the durability, storage stability, and fixing property of the bio-toner will be good, such being desirable. Here, the value of the average molecular weight by GPC is a value calculated by using monodisperse polystyrene as the standard sample.

A crosslinked component may also be present. The crosslinked component contains one or more crosslinkable monomer units such as, for example, divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate or diallyl phthalate, and combinations thereof. Further, it is possible to employ a monomer having a reactive group as a pendant group, such as glycidyl methacrylate, methylol acrylamide, or acrolein. Preferred is a radical polymerizable bifunctional monomer, and further preferred is divinylbenzene or hexanediol diacrylate.

The crosslinkable monomer unit is preferably present in the additional second resin in an amount of from about 0.05% by weight to about 10% by weight, more preferably from about 0.3% by weight to about 5% by weight, particularly preferably from about 0.8% by weight to about 3% by weight, per 100% by weight of the additional second resin. High temperature offset may be increased by the inclusion of an additional resin that has one or more crosslinkable monomer units.

Co-polymer Resins—The bio-resin and/or the second resin such as the petroleum resin may be a polyester resin and/or a polymer comprising one or more polyester units (e.g., a bio-resin co-polymer and/or a co-polyester). A polyester unit includes blocks of polyester units (e.g., units comprising at least one diol monomer unit and at least one dicarboxylic acid unit in their structure). Bio-resins containing polyester units, in addition to one or more other units, preferably include one or more other bio-monomers in the other resins. Such other resins may include one or more vinyl-based monomer units that may be derived from a renewable resource of petroleum.

Examples of monomer units which can be used to synthesize a bio-resin copolymer include styrene-based monomers selected from a nitrogen atom-containing vinyl monomer, a carboxyl group-containing monomer, a hydroxyl group-containing monomer, an acrylate monomer, and a methacrylate monomer. The styrene-based monomer may include, for example: styrenes such as styrene, o-methylstyrene, m-methylstyrene, p-methyl styrene, p-methoxystyrene, p-phenylstyrene, p-chlorostyrene, 3,4-dichlorostyreme, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene, and derivatives thereof.

Examples of a nitrogen atom-containing vinyl-based monomer include amino acid-containing α-methylene aliphatic monocarboxylate ester, such as dimethylaminoethyl methacrylate and diethylaminoethyl methacrylate, and derivatives of acrylic acid or methacrylic acid such as acrylonitrile, methacrylonitrile, and acrylamide.

Examples of carboxyl group-containing monomers include unsaturated dihydric acids such as maleic acid, citraconic acid, itaconic acid, alkenylsuccinic acid, fumaric acid, and mesaconic acid; unsaturated dihydric acid anhydrides such as maleic anhydride, citraconic anhydride, itaconic anhydride, and alkenylsuccinic anhydride; unsaturated basic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dihydric acid esters such as dimethyl maleate and dimethyl fumarate; α,β-unsaturated acids such as acrylic acid, methacrylic acid, crotonic acid, and cinnamic acid anhydrides of α,β-unsaturated acids such as crotonic acid anhydride and cinnamic acid anhydride, and anhydrides of the above-mentioned α,β-unsaturated acids and lower aliphatic acids; and alkenylmalonic acid, alkenylglutaric acid, and alkenyladipic acid, and acid anhydrides thereof and monoesters thereof.

Examples of hydroxyl group-containing monomers include acrylic esters or methacrylic esters such as 2-hydroxyethyl acrylate, 2-hydroxyethylmethacrylate, and 2-hydroxylpropyl methacrylate; and 4-(1-hydroxy-1-methylbutyl)styrene and 4-(1-hydroxy-1-methylhexyl)styrene.

Examples of acrylate monomers include acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate.

Examples of methacrylate monomers include an α-methylene aliphatic monocarboxylate such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethyl aminoethyl methacrylate.

Wax—Embodiments of the bio-toner preferably include one or more waxes such as, for example, a polyolefin wax, such as a low molecular weight polyethylene, a low molecular weight polypropylene or a copolymer polyethylene; a paraffin wax; an ester-type wax having a long chain aliphatic group such as behenyl behenate, a montanate or stearyl stearate; a wax derived from plants such as hydrogenated castor oil, carnauba wax; candellia wax, rice wax, haze wax, or jojoba oil; a ketone having a long chain alkyl group such as distearyl ketone; a silicone wax; a higher fatty acid such as stearic acid and its metal salt; a long chain aliphatic alcohol such as eicosanol; a carboxylic acid or partial ester of a polyhydric alcohol obtained from a long chain fatty acid and a polyhydric alcohol such as glycerol or pentaerythritol; a higher fatty acid amide such as an oleic acid amide or stearic acid amide; or a low molecular weight polyester.

In a preferable embodiment of the disclosure, the bio-toner includes WE3 and C5551 waxes commercially available from NOF Corporation of Japan and Clariant of Coventry, R.I., respectively. WE3 is an aliphatic ester-type wax comprised of a long carbon chain. C5551 is a low molecular weight polyethylene wax. In a preferable embodiment for magnetic bio-toner embodiments, the bio-toner can include WE10 wax available from NOF Corporation of Japan and C5551 wax. WE10 is an aliphatic ester-type wax comprised of a mixture of different lengths of carbon chains. In a more preferable embodiment for magnetic bio-toner embodiments, the bio-toner can include P110 wax available from Clariant of Coventry, R.I. P110 is a low molecular weight polyethylene wax. The bio-toner may contain one or more additional polyolefin waxes such as polypropylene waxes from Mitsui Chemicals of Tokyo, Japan, e.g., NP505. The bio-toner may contain a mixture of any of the above waxes.

For non-magnetic bio-toner embodiments, the wax is preferably present in the bio-toner in a total amount of 10% or less by weight based on the total weight of the bio-toner, and more preferably, the wax is present in the bio-toner in an amount of about 2% by weight to about 2.5% by weight, based on the total weight of the bio-toner. For magnetic bio-toner embodiments, the wax is preferably present in the bio-toner in a total amount of from about 1% by weight to about 30% by weight, more preferably from about 2% by weight to about 20% by weight, and most preferably from about 2% by weight to about 15% by weight, based on the total weight of the bio-toner and the total weight of all of the waxes. If the content of the wax is too low, performance properties such as low temperature fixing, high temperature offset, or anti-blocking may be inadequate, and if the wax is present in an amount that is too great, the wax is likely to leak from the bio-toner and/or cause image bleed.

Waxes may include the following: aliphatic hydrocarbon wax such as a low molecular weight polyethylene, a low molecular weight polypropylene, an alkylene copolymer, a microcrystalline wax, a paraffin wax, or a Fischer-Tropsch wax; an aliphatic hydrocarbon wax oxide such as a polyethylene oxide wax or block copolymers of aliphatic hydrocarbon waxes; a wax containing an aliphatic ester as a main component such as a carnauba wax, behenic acid behenyl, or a montanate wax; and a wax containing an aliphatic ester deoxidated partially or totally such as a deoxidated carnauba wax. Further, examples of the wax may include linear saturated aliphatic acids such as palmitic acid, stearic acid, and montan acid; unsaturated aliphatic acids such as brassidic acid, eleostearic acid, and barinarin acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of aliphatic acids such as palmitic acid, stearic acid, behenic acid, and montan acid and alcohols such as stearyl alcohol, aralkyl alcohol, behenyl alcohol, carnaubyl alcohol, ceryl alcohol, and melissyl alcohol; aliphatic amides such as linoleic amide, oleic amide, and lauric amide; saturated alphatic bis amides such as methylenebis stearamide, ethylene bis capramide, ethylene his lauramide, and hexamethylene his stearamide; unsaturated aliphatic amides such as ethylene bis oleamide, hexamethylene his oleamide, N,N'-dioleyl adipamide, and N,N'-dioleyl sebacamide; aromatic his amides such as m-xylene bis stearamide and N—N'-distearyl isophthalamide; aliphatic acid metallic salts (generally called metallic soaps) such as calcium stearate, calcium laurate, zinc stearate, and magnesium stearate; graft waxes in which aliphatic hydrocarbon waxes are grafted with vinyl-based monomers such as styrene and acrylic acid; partially esterified compounds of aliphatic acids and polyalcohols such as behenic monoglyceride; and methyl ester compounds having hydroxyl groups obtained by hydrogenation of vegetable oil.

A higher fatty acid ester wax, an olefin wax such as a copolymer polyethylene, or a paraffin wax is preferred. The higher fatty acid ester wax may specifically be preferably an ester of a $C_{15-30}$ aliphatic acid with a mono to pentahydric alcohol, such as behenyl behenate, stearyl stearate, a stearic acid ester of pentaerythritol, or montanic acid glyceride, which is preferably derived from a plant source. Further, the alcohol component of the ester preferably has from 10 to 30 carbon atoms in the case of a monohydric alcohol, and from 3 to 10 carbon atoms for polyhydric alcohols. Preferable silicone waxes include alkyl-modified silicone waxes.

Preferably, for magnetic bio-toner embodiments, the wax has a melting point of at least 40° C., more preferably at least 50° C., and particularly preferably at least 60° C. Further, for magnetic bio-toner embodiments, the wax has a melting point of preferably at most 150° C., more preferably at most 120° C., and particularly preferably at most 110° C. If the melting point is too low, the wax is likely to be exposed on the surface, thus presenting stickiness after the fixing, and if the melting point is too high, the fixing property at a low temperature tends to be poor.

DSC (Differential Scanning Calorimetry)—Differential scanning calorimetry or DSC is a thermoanalytical technique in which the difference in the amount of heat required to increase the temperature of a sample and reference are measured as a function of temperature. Preferably, the bio-toner has at least one peak temperature in a range of from about 60° C. (degrees Celsius) to about 120° C. (degrees Celsius) in a differential scanning calorimetry (DSC) measurement. If the peak temperature is outside this range, the wax is likely to be exposed on the surface, thus presenting stickiness after the fixing, or the fixing property at a low temperature tends to be poor.

Colorant—Embodiments of the bio-toner of the disclosure include one or more colorants, such as, for example, an inorganic pigment and/or an organic pigment or dye. Specifically, the colorant may comprise one or more of carbon black such as furnace black or lamp black, an acid dye or basic dye, such as a precipitate by a precipitating agent of an azo dye such as benzidine yellow or benzidine orange, or a dye such as quinoline yellow, acid green, or alkali blue, or a precipitate of a dye such as rhodamine, magenta, or malachite green by, e.g. tannic acid or phosphomolybdic acid, a mordant dye such as a metal salt of a hydroxyanthraquinone, an organic pigment such as a phthalocyanine pigment such as phthalocyanine blue or copper sulfonate phthalocyanine, a quinacridone pigment such as quinacridone red or quinacridone violet, or a dioxane pigment, or a synthetic dye such as aniline black, an azo dye, a naphthoquinone dye, an indigo dye, a nigrosine dye, a phthalocyanine dye, a polymethine dye, or a di- or tri-allylmethane dye. For non-magnetic bio-toner embodiments, preferably, the colorant comprises carbon black, an acid dye, a color dye, a color pigment, or a phthalocyanine colorant, or a mixture thereof. For magnetic bio-toner embodiments, preferably, the colorant comprises magnetite, carbon black, or a mixture thereof.

Although the bio-toner is preferably black, other disclosed embodiments include one or more colored dyes or pigments. A yellow colorant may be any one or more of C.I. pigment yellow, 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 or 199, or a dye such a C.I. solvent yellow 33, 56, 79, 82, 93, 112, 162, 163 or C.I. disperse yellow 42, 64, 201 or 211.

A magenta colorant may be any one or more of a C.I. pigment 2, 3, 5, 6, 7, 23, 48:2, 48:3, 48:4, 57:1, 81:1, 122, 146, 150, 166, 169, 177, 184, 185, 202, 206, 220, 221, 238, 254, 255, 269 or C.I. pigment violet 19.

A cyan colorant may be any one or more of a C.I. pigment blue 1, 7, 15, 15:1, 15:2, 15:3, 15:4, 60, 62 or 66.

Full color toners include colorants such as, for example, yellow, benzidine yellow, mono-azo dye or pigment or a condensed azo dye or pigment; for magenta, quinacridone or a mono-azo dye or pigment; and for cyan, phthalocyanine blue. The combination of the colorants may suitably be selected in consideration of the color, and the like. However, among them, as a yellow colorant, C.I. pigment yellow 74 or C.I. pigment yellow 93 is preferably employed; as a magenta colorant, C.I. pigment red 238, C.I. pigment red 269, C.I. pigment red 57:1, C.I. pigment red 48:2, or C.I. pigment red 122 is preferably employed; and as a cyan colorant, C.I. pigment blue 15:3 is preferably employed.

The colorant may be present in an amount sufficient to provide a bio-toner that forms a visible image by development. For example, the amount of colorant is preferably in a range of from about 1% by weight to about 25% by weight, based on the total weight of all of the components in the bio-toner. More preferably, for non-magnetic bio-toner embodiments, the amount of colorant is in a range of from about 2% by weight to about 20% by weight, based on the total weight of all of the components in the bio-toner, and even more preferably in a range of from about 3% by weight to about 10% by weight, based on the total weight of all of the components in the bio-toner. More preferably, for magnetic bio-toner embodiments, the amount of colorant is in a range of from about 1% by weight to about 15% by weight, based on the total weight of all of the components in the bio-toner, and even more preferably in a range of from about 3% by weight to about 12% by weight based on the total weight of the all of the components in the bio-toner.

Magnetic Component—In embodiments of the disclosure, the bio-toner may either include a magnetic component or exclude a magnetic component, e.g., the bio-toner may be a mono-component toner or developer or may be a dual component toner or developer.

For non-magnetic bio-toner embodiments, the non-magnetic bio-toner either comprises 0% to about 30% by weight or less than about 30% by weight of a magnetic component, based on the total weight of all of the components in the bio-toner, or excludes a magnetic component. More preferably, the bio-toner comprises 0% to about 15% by weight or less than about 15% by weight of a magnetic component, based on the total weight of all of the components in the bio-toner. Most preferably, the bio-toner comprises 0% to about 10% by weight or less than about 10% by weight of a magnetic component, based on the total weight of all of the components in the bio-toner. In a preferred embodiment, the colorant may also function as a magnetic component. For non-magnetic bio-toner embodiments, preferably, the content of the magnetic component in the bio-toner is in a range of from about 15 wt % to about 20 wt %, more preferably from about 0.5 wt % to about 8 wt %, and even more preferably from about 1 wt % to about 5 wt %.

For magnetic bio-toner embodiments, the content of the magnetic component in the bio-toner is preferably at least about 15 wt %, more preferably at least about 20 wt %, and the content of the magnetic component in the bio-toner is preferably at most about 70 wt %, and more preferably at most about 60 wt %, based on the total weight of all of the components in the bio-toner. If the content of the magnetic component is less than the above range, there may be a case where no adequate magnetic component as a magnetic bio-toner can be obtained, and if it exceeds the above range, such may cause a fixing concern. Preferably, the magnetic component in magnetic bio-toner embodiments is magnetite, carbon black, or a mixture thereof.

The magnetic component may be a ferromagnetic substance showing ferrimagnetism or ferromagnetism in the vicinity of from 0° C. to about 60° C. which is the typical operation temperature of printers, copying machines, and the like. Specifically, it may, for example, be magnetite ($Fe_3O_4$), magnematite ($\gamma$-$Fe_2O_3$), an intermediate or mixture of magnetite and magnematite, a spinel ferrite of the formula $MxFe_{3-x}O_4$ wherein x is 1 or 2, and M is Mg, Mn, Fe, Co, Ni, Cu, Zn, Cd or the like, a hexagonal ferrite such as $BaO_6Fe_2O_3$ or $SrO_6Fe_2O_3$, a garnet oxide such as $Y_3Fe_5O_{12}$ or $Sm_3Fe_5O$, a rutile oxide such as CrO, or one showing magnetism at a temperature in the vicinity of from 0° C. to 60° C. among metals such as Cr, Mn, Fe, Co and Ni, and their ferromagnetic alloys. Among them, magnetite, maghematite, or an intermediate of magnetite and maghematite is preferred. In a case where such a magnetic component is incorporated with a view to preventing backgrounding, scattering, or controlling the electrostatic property, or making the pulverization of the toner easier, while the characteristics as a bio-toner, such as a non-magnetic bio-toner, are maintained, the content of the magnetic component in the bio-toner is preferably less than about 30% by weight, more preferably less than about 15% by weight, and most preferably, less than about 10% by weight, based on the total weight of all of the components in the bio-toner.

In addition, a cobalt content of embodiments of the bio-toner is preferably less than 50 parts per million by weight based on a total weight of the bio-toner. One way to achieve this is to control the cobalt content of magnetite.

In the disclosed embodiments, in a case where an electrical conductivity is to be imparted to the bio-toner, an electroconductive carbon black or other conductive substance may be incorporated as the above colorant component. The content of such a conductive substance is preferably at a level of from about 0.05% by weight to about 5% by weight, based on the total weight of all of the components in the bio-toner.

Charge Control Agent—A charge control agent may be included in embodiments of the bio-toner to adjust the electrostatic charge and to impart the electrostatic stability. A positively chargeable charge control agent may, for example, be a nigrosine dye, a quaternary ammonium salt, a triaminotriphenylmethane compound, an imidazole compound, or a polyamine resin. A negatively chargeable charge control agent may, for example, be an azo complex compound dye containing an atom such as Cr, Co, Al, Fe, or B, salicylic acid, an alkyl salicylic acid complex compound, a calix (n) arene compound, a metal salt or metal complex of benzylic acid, an amide compound, a phenol compound, a naphthol compound, a phenolamide compound, a hydroxynaphthalene compound such as 4,4'-methylenebis[2-[N-(4-chlorophenyl) amido]-3-hydroxynaphthalene], quaternary ammonium salts; polymeric compounds having the quaternary ammonium salts at their side chains; guanidine compounds; and imidazole compounds.

Examples of a usable negatively charged charge control agent include metal compounds of salicylic acid; metal compounds of naphthoic acid; metal compounds of dicarboxylic acid; polymeric compounds each having a sulfonic acid or a carboxylic acid at any one of its side chains; boron compounds; urea compounds; silicon compounds; and calixarene. Each of those charge control agents may be internally or externally added to a toner particle. Preferably, for non-magnetic bio-toner embodiments, the charge control agent comprises an azo complex compound dye, salicylic acid, an alkyl salicylic acid complex compound, or another suitable charge control agent.

In particular, a metal compound of an aromatic carboxylic acid which is colorless and which is capable of charging the toner at a high speed while maintaining a constant charge amount; and being crosslinked with the second resins at the time of kneading is preferable.

In full color toners the charge control agent is preferably colorless. For this purpose, the positively chargeable charge control agent is preferably a quaternary ammonium salt or an imidazole compound, and the negatively chargeable charge control agent is preferably salicyclic acid or an alkyl salicylic acid complex compound containing an atom such as Cr, Co, Al, Fe, B or Zn, or a calix(n)arene compound or mixtures thereof. The amount of the charge control agent is preferably within a range of from about 0.01% by weight to about 5% by weight, based on the weight of all the components in the bio-toner, and more preferably, from about 0.05% by weight to about 3% by weight. For magnetic bio-toner embodiments, the amount of charge control agent is preferably from about 0.1% by weight to about 2% by weight, based on the total weight of all of the components in the bio-toner.

MeOH—The visible UV (ultra-violet) absorption of embodiments of the bio-toner can be measured by dispersing the bio-toner in MeOH (methanol) and measuring the visible UV (ultra-violet) absorption of the bio-toner. Preferably, embodiments of the bio-toner show at least one optical absorption peak in a wavelength range either between about 250 nanometers and about 350 nanometers or between about 450 nanometers and 650 nanometers, when dispersed in methanol (MeOH). More preferably, embodiments of the bio-toner show at least one optical absorption peak in a wavelength range between about 250 nanometers and about 350 nanometers, when dispersed in methanol (MeOH).

Other Additives—Further, the bio-toner of the disclosure may contain various known additives such as a silicone oil, a silicone varnish, or a fluorinated oil in the bio-toner, for the purpose of modifying e.g. the adhesive property, agglomeration property, flowability, electrification property, surface resistance, and similar properties of the bio-toner. Preferably, the bio-toner may comprise one or more additives such as large particles (about 30 nm (nanometers) to about 100 nm (nanometers)) of silicon dioxide, small particles (about 7 nm to about 15 nm) of silicon dioxide, aluminum oxide, titanium dioxide, silicon carbide, or a mixture thereof. For example, silicon carbide can act as a polishing agent for the bio-toner, and titanium dioxide can act as a flowability agent for the bio-toner. Preferably, the total amount of the one or more additives may be in the amount of about 0.2 wt % to about 5.0 wt %, based on the total weight of the bio-toner, and preferably about 0.5 wt % to about 3.0 wt %, based on the total weight of the bio-toner.

Developing System—For non-magnetic bio-toner embodiments disclosed herein, the non-magnetic bio-toner of the disclosure may be a bio-toner for use in a dual component development system or a non-magnetic mono-component development system. A dual component development system is one that requires the use of a carrier to assist the development of an image in order for the bio-toner to be used to prepare images. A mono-component development system is more demanding in the design of the toner to produce acceptable images, since the toner in a mono-component development system has to play the functions of both the carrier and the toner in the dual component development system. Further, the toner in a mono-component development system is required to have a narrower tribo charge distribution and has to be electrically charged in a shorter period of time than the toner in a dual component development system.

Particle Size—The particles of embodiments of the bio-toner of the disclosure preferably have a D50 particle size of from about 4 μm (micrometers) to about 11 μm (micrometers), and more preferably, from about 5 μm to about 10 μm.

Image Density—For purposes of this application, the term "image density" (ID) means the relative blackness or color density of a developed image of a solid area on a paper from an electrophotographic image forming device such as a laser printer, as measured by a reflection densitometer. The ID is calculated as $-\log_{10}(I/I_0)$, where $I_0$ is the intensity of the incident light and I is the intensity of the reflected light. The printed image on paper has to have a dark image and clean background free of blemishes. Generally, in black and white printing, the solid image area is preferred to have an ID greater than about 1.3, and more preferably, greater than about 1.5, so that the image is crisp and comfortable to view or read. The ID of a developed image using embodiments of the bio-toner of the disclosure was found to be greater than about 1.3, and in some embodiments was found to be greater than about 1.5.

Background—For purposes of this application, the term "background" (BG) means the undesirable presence of toner particles in the non-image areas on a white sheet paper subsequent to the electrophotographic process such as laser printing. The smaller the BG value, the more desirable the image is. Generally, in black and white printing, the BG is preferably less than about 5, and more preferably, less than about 3, so that the image is crisp and comfortable to view or read. The BG of a developed image using embodiments of the bio-toner of the disclosure was found to be less than about 3.0, and in some embodiments was found to be less than about 2.0.

Gloss—For purposes of this application, the term "gloss" means an optical property which is based on the interaction of light with physical characteristics of a surface, and it is the ability of a surface to reflect light into a specific direction. Factors that affect gloss are the refractive index of the material, the angle of incident light, and the surface topography. Generally, high gloss, such as greater than 5, may be achieved in graphic printing, so that the image is crisp and comfortable to view or read. The gloss of a developed image using embodiments of the bio-toner of the disclosure was found to be greater than 8, and in some embodiments was found to be greater than 10.

Fixing—For purposes of this application, the term "fixing" means the adhesion or fusing strength between the paper and the toner subsequent to the electrophotographic process such as laser printing. Once toner has been deposited on the paper and exposed to fusing conditions, the toner has a fusing strength. Generally, in black and white printing, fixing greater than about 80% may be considered usable, and fixing greater than about 90% may be considered good. The fixing of a developed image using embodiments of the bio-toner of the disclosure was found to be greater than 90% and in some embodiments was found to be greater than about 95%.

Offset—For purposes of this application, the term "offset" means the undesirable phenomenon in which part of a fused toner image is adhered to a surface of the fixing member, and re-transferred onto an undesired portion of the recording medium. Generally, in black and white printing, there should be none or zero offsetting. The offset of a developed image using embodiments of the bio-toner of the disclosure was found to be "None" and in some embodiments was found to be "Slight".

Preferred Embodiments

In one embodiment of the bio-toner of the disclosure, there is provided a bio-toner comprising a bio-resin, a second resin, and one or more colorants, wherein the bio-resin is a polyester polymer comprising one or more reacted di-acid monomer units and one or more reacted diol monomer units, and further wherein at least one of the reacted di-acid monomer units or at least one of the reacted diol monomer units is a bio-monomer obtained from a plant or an animal source. Preferably, the bio-resin has a softening point in the range of from about 80 degrees Celsius to about 170 degrees Celsius. More preferably, the bio-resin has a softening point in the range of from about 100 degrees Celsius to about 150 degrees Celsius. Most preferably, the bio-resin has a softening point in the range of from about 130 degrees Celsius to about 135 degrees Celsius. The bio-resin may preferably comprise reacted units of 1,4-cyclohexane dicarboxylic acid, a $C_{18}$ fatty acid dimerization product of one or more of oleic acid, linoleic acid, and linolenic acid, trimethylol propane, isosorbide, or a mixture thereof. The bio-resin preferably contains reacted monomer units that are derived from soy beans or corn. Preferably, at least 5 weight % of at least one of the diol monomer units or at least one of the di-acid monomer units are bio-monomers obtained from a plant or animal source, where weight % is based on the total weight % of the diol monomer units and the di-acid monomer units in the bio-resin. More preferably, at least 5 weight % of at least one of the diol monomer units and at least one of the di-acid monomer units are bio-monomers obtained from a plant or animal source, where weight % is based on the total weight % of the diol monomer units and the di-acid monomer units in the bio-resin. The second resin preferably has a softening point in a range of from about 90 degrees Celsius to about 140 degrees Celsius. The second resin may be present in an amount of from about 1% by weight to about 50% by weight, wherein % by weight is based on the total weight of the bio-resin and the second resin. The second resin of the bio-toner is preferably a polymer comprising one or more petroleum-based monomers. The second resin may comprise styrene acrylate resins or polyesters resins. The second resin may preferably comprise MC400 polyester resin, MC500 polyester resin, or a mixture thereof. The one or more colorants of the bio-toner may preferably comprise magnetite, carbon black, an acid dye, a color dye, a color pigment, a phthalocyanine colorant, or a mixture thereof. The bio-toner preferably has a cobalt content of less than 50 parts per million by weight based on a total weight of the bio-toner. The bio-toner may further comprise more than about 30% by weight of a magnetic component, based on a total weight of the bio-toner. The bio-toner may further comprise a charge control agent preferably comprising an azo complex compound dye, salicylic acid, or an alkyl salicylic acid complex compound. Preferably, the bio-toner shows at least one optical absorption peak in a wavelength range either between about 250 nanometers and about 350 nanometers or between about 450 nanometers and 650 nanometers, when dispersed in methanol (MeOH). More preferably, the bio-toner shows at least one optical absorption peak in a wavelength range between about 250 nanometers and about 350 nanometers, when dispersed in methanol (MeOH). The bio-toner may further comprise a wax comprising one or more of an ester-type wax and a hydrocarbon-type wax. Preferably, the wax present is in an amount of from about 1% by weight to about 10% by weight, based on a total weight of the bio-resin, the second resin, the one or more colorants, and the wax. Preferably, the wax comprises one or more of P110, WE10, WE3, and C5551. More preferably, the wax comprises P110 or WE10. Preferably, the bio-toner has at least one peak temperature in a range of from about 60 degrees Celsius to about 120 degrees Celsius in a differential scanning calorimetry (DSC) measurement. The bio-toner may further comprise one or more additives preferably comprising silicon dioxide, aluminum oxide, titanium dioxide, and silicon carbide. Preferably, at least one additive has a particle size of greater than 30 nanometers (nm). The bio-toner preferably has a D50 particle size in a range of from about 4 micrometers (μm) to about 11 micrometers (μm). More preferably, the bio-toner has a D50 particle size in a range of from about 5 micrometers (μm) to about 10 micrometers (μm). Preferably, the bio-toner has a bio-based content of at least 5% according to ASTM D6866-08. More preferably, the bio-toner has a bio-based content of at least 30% according to ASTM D6866-08. Most preferably, the bio-toner has a bio-based content of at least 50% according to ASTM D6866-08.

In another embodiment of the bio-toner of the disclosure, there is provided a bio-toner comprising a bio-resin, a second resin, a wax, and one or more colorants, wherein the bio-resin is a polyester polymer comprising one or more reacted di-acid monomer units and one or more reacted diol monomer units, and wherein at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin. Preferably, the bio-resin has a softening point in the range of from about 80 degrees Celsius to about 170 degrees Celsius. More preferably, the bio-resin has a softening point in the range of from about 100 degrees Celsius to about 150 degrees Celsius. Most preferably, the bio-resin has a softening point in the range of from about 130 degrees Celsius to about 135 degrees Celsius. The bio-resin may preferably comprise reacted units of 1,4-cyclohexane dicarboxylic acid, a $C_{18}$ fatty acid dimerization product of one or more of oleic acid, linoleic acid, and linolenic acid, trimethylol propane, isosorbide, or a mixture thereof. The bio-resin preferably contains reacted monomer units that are derived from soy beans or corn. Preferably, at least 5 weight % of at least one of the diol monomer units or at least one of the di-acid monomer units are bio-monomers obtained from a plant or animal source, where weight % is based on the total weight % of the diol monomer units and the di-acid monomer units in the bio-resin. More preferably, at least 5 weight % of at least one of the diol monomer units and at least one of the di-acid monomer units are bio-monomers obtained from a plant or animal source, where weight % is based on the total weight % of the diol monomer units and the di-acid monomer units in the bio-resin. The second resin preferably has a softening point in a range of from about 90 degrees Celsius to about 140 degrees Celsius. The second resin may be present in an amount of from about 1% by weight to about 50% by weight, wherein % by weight is based on the total weight of the bio-resin and the second resin. The second resin of the bio-toner is preferably a polymer comprising one or more petroleum-based monomers. The second resin may comprise styrene acrylate resins or polyesters resins. The second resin may preferably comprise MC400 polyester resin, MC500 polyester resin, or a mixture thereof. The one or more colorants of the bio-toner may preferably comprise magnetite, carbon black, or a mixture thereof. The bio-toner preferably has a cobalt content of less than 50 parts per million by weight based on a total weight of the bio-toner. The bio-toner may further comprise more than about 30% by weight of a magnetic component, based on a total weight of the bio-toner. The bio-toner may further comprise a charge control agent preferably comprising an azo complex compound dye, salicylic acid, or an alkyl salicylic acid complex compound. Preferably, the bio-toner shows at least one optical absorption peak in a wavelength range either between about 250 nanometers and about 350 nanometers or between about 450 nanometers and 650 nanometers, when dispersed in methanol (MeOH). More preferably, the bio-toner shows at least one optical absorption peak in a wavelength range between about 250 nanometers and about 350 nanometers, when dispersed in methanol (MeOH). The bio-toner may further comprise a wax comprising one or more of an ester-type wax and a hydrocarbon-type wax. Preferably, the wax present is in an amount of from about 1% by weight to about 10% by weight, based on a total weight of the bio-resin, the second resin, the one or more colorants, and the wax. Preferably, the wax comprises one or more of P110, WE10, WE3, and C5551. More preferably, the wax comprises P110 or WE10. Preferably, the bio-toner has at least one peak temperature in a range of from about 60 degrees Celsius to about 120 degrees Celsius in a differential scanning calorimetry (DSC) measurement. The bio-toner may further comprise one or more additives preferably comprising silicon dioxide, aluminum oxide, titanium dioxide, and silicon carbide. Preferably, at least one additive may have a particle size of greater than 30 nanometers (nm). The bio-toner preferably has a D50 particle size in a range of from about 4 micrometers (μm) to about 11 micrometers (μm). More preferably, the bio-toner has a D50 particle size in a range of from about 5 micrometers (μm) to about 10 micrometers (μm). Preferably, the bio-toner has a bio-based content of at least 10% according to ASTM D6866-08. More preferably, the bio-toner has a bio-based content of at least 30% according to ASTM D6866-08. Most preferably, the bio-toner has a bio-based content of at least 50% according to ASTM D6866-08. Preferably, the bio-resin and the second resin of the bio-toner are present in a total amount of greater than 30% by weight, the wax is present in an amount of 10% or less by weight, and the one or more colorants is present in an amount of 60% or less by weight, wherein % by weight is based on the total weight of the bio-resin, the second resin, and the one or more colorants.

In another embodiment of the bio-toner of the disclosure, there is provided a magnetic bio-toner. The bio-toner comprises a bio-resin present in an amount of 23% or more by weight. The bio-toner further comprises a second resin present in an amount of 18% or less by weight, wherein the second resin preferably comprises MC400 polyester resin, MC500 polyester resin, or a mixture thereof. The bio-toner further comprises a wax present in an amount of 8% or less by weight, wherein the wax preferably comprises P110 or WE10. The bio-toner further comprises one or more colorants present in an amount of 49% or less by weight, wherein the one or more colorants preferably comprises magnetite, carbon black, or a mixture thereof. The bio-toner further comprises a charge control agent present in an amount of 2% or less by weight, wherein the charge control agent preferably comprises an azo complex compound dye, salicylic acid, and an alkyl salicylic acid complex compound. The % by weight of all of the components is based on the total weight of the bio-resin, the second resin, the wax, the one or more colorants, and the charge control agent. Preferably, the bio-resin is a polyester polymer comprising one or more reacted di-acid monomer units and one or more reacted diol monomer units, and preferably, at least a 5% by weight total of at least one of the diol monomer units or at least one of the di-acid monomer units are bio-monomers obtained from a plant or an animal source.

There is provided in another embodiment a bio-toner comprising a bio-resin, a second resin, a wax, and one or more colorants. The bio-resin is preferably a polyester polymer comprising reacted di-acid monomer units and reacted diol monomer units. Preferably, at least 50 mol % of at least one of the diol monomer units and the di-acid monomer units are bio-monomers obtained from a plant or animal source, where mol % is based on the total number of mols of the diol monomer units or the di-acid monomer units, respectively. The second resin is preferably a polymer comprising one or more petroleum-based monomers. Preferably, at least 50 mol % of the diol monomer units are bio-monomers obtained from a plant or animal source, based on the total number of reacted units of diol monomers in the bio-resin. Preferably, the bio-resin has a softening point in the range of from about 80 degrees Celsius to about 170 degrees Celsius. More preferably, the bio-resin has a softening point in the range of from about 100 degrees Celsius to about 150 degrees Celsius. Most preferably, the bio-resin has a softening point in the range of from about 130 degrees Celsius to about 135 degrees Celsius. The softening point of the second resin may be in the range of from about 90 degrees Celsius to about 180 degrees Celsius. The second resin may preferably comprise MC400 polyester resin, MC500 polyester resin, or a mixture thereof. The bio-resin preferably comprises reacted units of 1,4-cyclohexane dicarboxylic acid, isosorbide, a $C_{18}$ fatty acid dimerization product of one or more of oleic acid, linoleic acid and linolenic acid, and trimethylol propane. The bio-resin of the bio-toner may be present in an amount of up to 80% by weight, and the second resin may be present in an amount of up to 20% by weight, wherein % by weight is based on the total weight of the first and second resins. The bio-resin may contain reacted monomer units that are derived from soy beans. Preferably, the bio-based content of the bio-toner is at least 20% according to ASTM D6866-08. More preferably, the bio-based content of the bio-toner is at least 35% according to ASTM D6866-08.

In another embodiment of the bio-toner of the disclosure there is provided a bio-toner comprising a bio-resin, one or more colorants, and 0% to about 30% by weight of a magnetic component, based on a total weight of the bio-resin, the one or more colorants, and the magnetic component, if present, wherein the bio-resin is preferably a polyester polymer comprising one or more reacted di-acid monomer units and one or more reacted diol monomer units, and further wherein preferably at least one of the reacted di-acid monomer units or at least one of the reacted diol monomer units is a bio-monomer obtained from a plant or an animal source. Preferably, the bio-resin has a softening point in the range of from about 80 degrees Celsius to about 170 degrees Celsius. More preferably, the bio-resin has a softening point in the range of from about 100 degrees Celsius to about 150 degrees Celsius. Most preferably, the bio-resin has a softening point in the range of from about 130 degrees Celsius to about 135 degrees Celsius. The bio-resin may preferably comprise reacted units of 1,4-cyclohexane dicarboxylic acid, a $C_{18}$ fatty acid dimerization product of one or more of oleic acid, linoleic acid, and linolenic acid, trimethylol propane, isosorbide, or a mixture thereof. More preferably, the bio-resin comprises reacted units of isosorbide. More preferably, the bio-resin comprises two reacted di-acid monomer units and one reacted diol monomer unit. The bio-resin may contain reacted monomer units that are derived from soy beans or corn. Preferably, at least about 5% by weight total of at least one of the di-acid monomer units or at least one of the diol monomer units are bio-monomers obtained from a plant or an animal source. More preferably, at least about 5% by weight total of at least one of the di-acid monomer units and at least one of the diol monomer units are bio-monomers obtained from a plant or an animal source. Even more preferably, at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin. Even more preferably, at least 50 weight % of at least one of the diol monomer units and at least one of the di-acid monomer units are bio-monomers obtained from a plant or animal source, where weight % is based on the total weight % of the diol monomer units and the di-acid monomer units in the bio-resin. The bio-toner may further comprise a second resin comprising a polymer of one or more petroleum-based monomers. The second resin may comprise styrene acrylate resins or polyesters resins. The second resin may preferably comprise MC400 polyester resin, MC500 polyester resin, or a mixture thereof. The second resin preferably has a softening point in a range of from about 90 degrees Celsius to about 140 degrees Celsius. The second resin may be present in an amount of from about 1% by weight to about 50% by weight, wherein % by weight is based on the total weight of the bio-resin and the second resin. The one or more colorants of the bio-toner may preferably comprise one or more of carbon black, an acid dye, a color dye, a color pigment, and a phthalocyanine colorant. The magnetic component is preferably in an amount of less than about 15% by weight based on a total weight of the bio-resin, one or more colorants, and the magnetic component, if present. The bio-toner may further comprise a charge control agent preferably comprising an azo complex compound dye, salicylic acid, or an alkyl salicylic acid complex compound. Preferably, the bio-toner shows at least one optical absorption peak in a wavelength range either between about 250 nanometers and about 350 nanometers or between about 450 nanometers and 650 nanometers, when dispersed in methanol (MeOH). More preferably, the bio-toner shows at least one optical absorption peak in a wavelength range between about 250 nanometers and about 350 nanometers, when dispersed in methanol (MeOH). The bio-toner may further comprise a wax comprising one or more of an ester-type wax and a hydrocarbon-type wax. The wax may preferably comprise one or more of WE3 and C5551. The wax may be present in an amount of from about 1% by weight to about 10% by weight, based on the total weight of the bio-resin, the second resin, the one or more colorants, and the wax. Preferably, the bio-toner has at least one peak temperature in a range of from about 60 degrees Celsius to about 120 degrees Celsius in a differential scanning calorimetry (DSC) measurement. The bio-toner may further comprise one or more additives comprising silicon dioxide, aluminum oxide, titanium dioxide, and silicon carbide. Preferably, at least one additive may have a particle size greater than 30 nanometers. Preferably, the bio-toner has a D50 particle size in a range of from about 4 micrometers (μm) to about 11 micrometers (μm). More preferably, the bio-toner has a D50 particle size in a range of from about 5 micrometers (μm) to about 10 micrometers (μm). Preferably, the bio-toner has a bio-based content of at least 5% according to ASTM D6866-08. More preferably, the bio-toner has a bio-based content of at least 30% according to ASTM D6866-08. Most preferably, the bio-toner has a bio-based content of is at least 50% according to ASTM D6866-08. Preferably, the bio-resin and the second resin are present in a total amount of greater than 80% by weight, the one or more colorants is present in an amount of 10% or less by weight, and the magnetic component is present in an amount of less than 10% by weight, wherein % by weight is based on the total weight of the bio-resin, the one or more colorants, and the magnetic component.

In another embodiment of the bio-toner of the disclosure, there is provided a non-magnetic bio-toner. The bio-toner comprises a bio-resin present in an amount of 85% or more by weight. The bio-toner further comprises one or more colorants present in an amount of 8% or less by weight, wherein the one or more colorants preferably comprises carbon black, an acid dye, a color dye, a color pigment, and a phthalocyanine colorant. The bio-toner further comprises a charge control agent present in an amount of less than 2.0% by weight, wherein the charge control agent preferably comprises an azo complex compound dye, salicylic acid, or an alkyl salicylic acid complex compound. The bio-toner further comprises a wax present in an amount of less than 5% by weight, wherein the wax preferably comprises WE3. The percent (%) by weight is based on the total weight of the bio-resin, the one or more colorants, the charge control agent, and the wax. Preferably, the bio-resin is a polyester polymer comprising one or more reacted di-acid monomer units and one or more reacted diol monomer units. Preferably, at least a 5% by weight total of at least one of the diol monomer units or at least one of the di-acid monomer units are bio-monomers obtained from a plant or an animal source.

In another embodiment of the bio-toner of the disclosure, there is provided a non-magnetic bio-toner. The bio-toner comprises a bio-resin present in an amount of 59.5% or more by weight. The bio-toner further comprises a petroleum-based resin present in an amount of 25.5% or less by weight. The bio-toner further comprises one or more colorants present in an amount of 8% or less by weight, wherein the one or more colorants preferably comprises carbon black, an acid dye, a color dye, a color pigment, and a phthalocyanine colorant. The bio-toner further comprises a charge control agent present in an amount of less than 2.0% by weight, wherein the charge control agent preferably comprises an azo complex compound dye, salicylic acid, or an alkyl salicylic acid complex compound. The bio-toner further comprises a wax present in an amount of less than 5% by weight, wherein the wax preferably comprises WE3. The percent (%) by weight is based on the total weight of the bio-resin, the petroleum-based resin, the one or more colorants, the charge control agent, and the wax. Preferably, the bio-resin is a polyester polymer comprising one or more reacted di-acid monomer units and one or more reacted diol monomer units. Preferably, at least a 5% by weight total of at least one of the diol monomer units or at least one of the di-acid monomer units are bio-monomers obtained from a plant or an animal source.

In additional bio-toner embodiments of the disclosure, there are provided: a bio-toner comprising a bio-resin, one or more colorants, a second resin, and less than about 30% by weight of a magnetic component, based on a total weight of the bio-resin, the one or more colorants, the second resin, and the magnetic component; or, a bio-toner comprising a bio-resin, one or more colorants, a charge control agent, and less than about 30% by weight of a magnetic component, based on a total weight of the bio-resin, the one or more colorants, the charge control agent, and the magnetic component; or, a bio-toner comprising a bio-resin, one or more colorants, a charge control agent, a second resin, and less than about 30% by weight of a magnetic component, based on a total weight of the bio-resin, the one or more colorants, the charge control agent, the second resin, and the magnetic component; or, a bio-toner comprising a bio-resin, one or more colorants, a charge control agent, a wax, and less than about 30% by weight of a magnetic component, based on a total weight of the bio-resin, the one or more colorants, the charge control agent, the wax and the magnetic component; or, a bio-toner comprising a bio-resin, one or more colorants, a charge control agent, a wax, a second resin, and less than about 30% by weight of a magnetic component, based on a total weight of the bio-resin, the one or more colorants, the charge control agent, the wax, the second resin, and the magnetic component; or, a bio-toner comprising a bio-resin, one or more colorants, a charge control agent, a wax, an additive, and less than about 30% by weight of a magnetic component, based on a total weight of the bio-resin, the one or more colorants, the charge control agent, the wax, the additive, and the magnetic component; or, a bio-toner comprising a bio-resin, one or more colorants, a charge control agent, a wax, an additive, a second resin, and less than about 30% by weight of a magnetic component, based on a total weight of the bio-resin, the one or more colorants, the charge control agent, the wax, the additive, the second resin, and the magnetic component; wherein for all of these embodiments, the bio-resin is preferably a polyester polymer comprising one or more reacted di-acid monomer units and one or more reacted diol monomer units, and preferably, at least one of the reacted di-acid monomer units or at least one of the reacted diol monomer units is a bio-monomer obtained from a plant or an animal source.

In additional bio-toner embodiments of the disclosure, there are provided bio-toners for use in a dual component development system, where: the bio-toner comprises a bio-resin and one or more colorants; or, the bio-toner comprises a bio-resin, one or more colorants, and a second resin; or, the bio-toner comprises a bio-resin, one or more colorants, and a charge control agent; or, the bio-toner comprises a bio-resin, one or more colorants, a charge control agent, and a second resin; or, the bio-toner comprises a bio-resin, one or more colorants, a charge control agent, and a wax; or, the bio-toner comprises a bio-resin, one or more colorants, a charge control agent, a wax, and a second resin; or, the bio-toner comprises a bio-resin, one or more colorants, a charge control agent, a wax, and an additive; or, the bio-toner comprises a bio-resin, one or more colorants, a charge control agent, a wax, an additive, and a second resin; wherein for all of these embodiments, the bio-resin is preferably a polyester polymer comprising one or more reacted di-acid monomer units and one or more reacted diol monomer units, and preferably, at least one of the reacted di-acid monomer units or at least one of the reacted diol monomer units is a bio-monomer obtained from a plant or an animal source.

In additional bio-toner embodiments of the disclosure, there are provided bio-toners for use in a non-magnetic mono-component development system, where: the bio-toner comprises a bio-resin and one or more colorants; or, the bio-toner comprises a bio-resin, one or more colorants, and a second resin; or, the bio-toner comprises a bio-resin, one or more colorants, and a charge control agent; or, the bio-toner comprises a bio-resin, one or more colorants, a charge control agent, and a second resin; or, the bio-toner comprises a bio-resin, one or more colorants, a charge control agent, and a wax; or, the bio-toner comprises a bio-resin, one or more colorants, a charge control agent, a wax, and a second resin; or, the bio-toner comprises a bio-resin, one or more colorants, a charge control agent, a wax, and an additive; or, the bio-toner comprises a bio-resin, one or more colorants, a charge control agent, a wax, an additive, and a second resin; wherein for all of these embodiments, the bio-resin is preferably a polyester polymer comprising one or more reacted di-acid monomer units and one or more reacted diol monomer units, and preferably, at least one of the reacted di-acid monomer units or at least one of the reacted diol monomer units is a bio-monomer obtained from a plant or an animal source.

Process/Method—In another embodiment of the disclosure, there is provided a method of making a bio-toner, for example, a non-magnetic bio-toner or a magnetic bio-toner, for use in electrophotographic image forming that contains a bio-resin that is at least partially derived from a renewable resource. In another embodiment of the invention there is provided a method for printing and forming an electrophotographic image on a substrate, such as paper, using a bio-toner, such as a non-magnetic bio-toner or a magnetic bio-toner, that contains a bio-resin that is at least partially derived from a renewable resource. In one embodiment there is provided a method of making a bio-toner. The method comprises mixing a bio-resin, a second resin, and one or more colorants, all as discussed above, in a mixing apparatus to form a bio-resin mixture. The method further comprises kneading the bio-resin mixture in an extruder apparatus to form an extruded bio-resin mixture. The method further comprises pulverizing the extruded bio-resin mixture in a pulverizing apparatus to form a pulverized bio-resin mixture. The method further comprises classifying the pulverized bio-resin mixture to obtain a classified bio-resin mixture. For purposes of this application, the term "classifying" means selecting toner with desired particle size out of a broader particle size distribution. The method further comprises adding one or more additives, as discussed above, to the classified bio-resin mixture to form the bio-toner. Preferably, the bio-resin is a polyester polymer comprising one or more reacted di-acid monomer units and one or more reacted diol monomer units, and preferably, at least one of the reacted di-acid monomer units or at least one of the reacted diol monomer units is a bio-monomer obtained from a plant or an animal source. In one embodiment, a kneading barrel set temperature in the extruder apparatus is less than a softening point temperature of the bio-resin. In another embodiment, a kneading barrel set temperature in the extruder apparatus is greater than a lowest differential scanning calorimetry (DSC) peak temperature of the bio-toner. In another preferred embodiment, a kneading barrel set temperature in the extruder apparatus is greater than a lowest differential scanning calorimetry (DSC) peak temperature of the bio-toner and less than a softening point temperature of the bio-resin.

In another embodiment there is provided a method of making a bio-toner comprising mixing a bio-resin, a second resin, a wax, and one or more colorants, all as discussed above, in a mixing apparatus to form a bio-resin mixture. The method further comprises kneading the bio-resin mixture in an extruder apparatus to form an extruded bio-resin mixture. The method further comprises pulverizing the extruded bio-resin mixture in a pulverizing apparatus to form a pulverized bio-resin mixture. The method further comprises classifying the pulverized bio-resin mixture to obtain a classified bio-resin mixture. The method further comprises adding one or more additives, as discussed above, to the classified bio-resin mixture to form the bio-toner. Preferably, the bio-resin is a polyester polymer comprising one or more reacted di-acid monomer units and one or more reacted diol monomer units, and preferably, at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin. In one embodiment, a kneading barrel set temperature in the extruder apparatus is less than a softening point temperature of the bio-resin. In another embodiment, a kneading barrel set temperature in the extruder apparatus is greater than a lowest differential scanning calorimetry (DSC) peak temperature of the bio-toner. In another preferred embodiment, a kneading barrel set temperature in the extruder apparatus is greater than a lowest differential scanning calorimetry (DSC) peak temperature of the bio-toner and less than a softening point temperature of the bio-resin.

In another embodiment there is provided a method of making a bio-toner comprising mixing a bio-resin, one or more colorants, and 0% to about 30% by weight of a magnetic component, based on a total weight of the bio-resin, the one or more colorants, and the magnetic component, if present, in a mixing apparatus to form a bio-resin mixture. The method further comprises kneading the bio-resin mixture in an extruder apparatus to form an extruded bio-resin mixture. The method further comprises pulverizing the extruded bio-resin mixture in a pulverizing apparatus to form a pulverized bio-resin mixture. The method further comprises classifying the pulverized bio-resin mixture to obtain a classified bio-resin mixture. The method further comprises adding one or more additives, as discussed above, to the classified bio-resin mixture to form the bio-toner. Preferably, the bio-resin is a polyester polymer comprising one or more reacted di-acid monomer units and one or more reacted diol monomer units, and preferably, at least one of the reacted di-acid monomer units or at least one of the reacted diol monomer units is a bio-monomer obtained from a plant or an animal source. In one embodiment, a kneading barrel set temperature in the extruder apparatus is less than a softening point temperature of the bio-resin. In another embodiment, a kneading barrel set temperature in the extruder apparatus is greater than a lowest differential scanning calorimetry (DSC) peak temperature of the bio-toner. In another preferred embodiment, a kneading barrel set temperature in the extruder apparatus is greater than a lowest differential scanning calorimetry (DSC) peak temperature of the bio-toner and less than a softening point temperature of the bio-resin.

In another embodiment of the disclosure, there is provided a method for electrophotographic image formation using a bio-toner, such as a non-magnetic bio-toner or a magnetic bio-toner, that contains a bio-resin that is at least partially derived from a renewable resource. The method comprises forming an image on a substrate, such as paper, where the image comprises the bio-toner of the disclosure.

Another embodiment of the disclosure includes a method for forming an image using an apparatus having a wiper blade for cleaning a photoconductive surface and a doctor blade for distributing a bio-toner, such as a non-magnetic bio-toner or a magnetic bio-toner, on a developing sleeve surface.

The method is preferably carried out with an electrophotographic image forming apparatus such as a printer, a laser printer, a copier, a facsimile apparatus, and/or any other apparatus which may be used to electrostatically reproduce a latent image on a photoconductive surface to deposit one or more embodiments of the bio-toner of the disclosure on the electrostatically charged photoconductive surface to form a bio-toner-based image, to transfer the bio-toner-based image to a substrate, such as paper; and to fuse the bio-toner-based image to affix the bio-toner-based image onto the substrate and form the final image on the substrate.

The process or method of forming an image with embodiments of the bio-toner of the disclosure may be carried out with any electrophotographic image forming apparatus. Preferably, the apparatus includes a printer cartridge in which the bio-toner is stored. The cartridge may have a bottle shape and may be used for storage and transport of the bio-toner before the bio-toner is installed in the apparatus.

In one aspect of the disclosure, the process or method is carried out on an electrophotographic image forming apparatus that includes a developing sleeve, a photoconductive surface for forming an electrostatic image, a doctor blade or a doctor bar for distributing bio-toner on the developing sleeve, a wiper blade for removing excess bio-toner from the developing sleeve and/or the photoconductive surface, and a fuser for fusing an electrostatic image deposited onto a substrate to form a permanent image. The developing sleeve may be any type of developing sleeve conventionally used in electrophotographic image forming processes and/or devices. The photoconductive surface may be any type conventionally used in electrophotographic image forming processes and/or devices. Preferably, both the developing sleeve and the photoconductive surface are cylindrical in shape having a smooth circumferential surface and preferably both rotate axially. Likewise, the fuser may be any type of known fusing devices used to fuse toners onto substrates in the electrophotographic image forming processes and devices.

FIG. 1A is a schematic diagram of various internal components of an electrophotographic image forming device 10, such as a laser printer, for carrying out electrophotographic printing. In FIG. 1A a photoconductive drum and/or photoconductive surface is shown as 1. A doctor blade 3*a* distributes a toner 2 onto a developing sleeve 4 with or without touching the developing sleeve 4. In other disclosed embodiments, the doctor blade 3*a* distributes the toner 2 on one or more other components of the electrophotographic image forming device 10, where such components subsequently distribute the toner 2 onto the photoconductive drum or surface 1. Such other components may include devices such as a sump which provides a reservoir of toner material. In another embodiment, as shown in FIG. 1B, a doctor bar 3*b* may be used instead of a doctor blade 3*a* in the electrophotographic image forming device 10 of FIG. 1A. A wiper blade 5 functions to remove excess toner from the photoconductive drum or surface 1 and/or to remove substantially all traces of the toner 2 from at least a portion of the photoconductive drum or surface 1. The wiper blade 5 is preferentially in direct contact with the photoconductive drum or surface 1 at a terminal end of the wiper blade 5 oriented laterally across the width of the photoconductive drum or surface 1. A transfer roller 8 pulls the toner 2 down to a substrate 9*a*, such as a piece of paper. The substrate or paper 9*a* is guided in a substrate or paper direction 9*b* in the electrophotographic image forming device 10. Fuser 6 functions to prepare the image for fixing onto the substrate or paper 9*a* after the toner-based image is transferred from the photoconductive drum or surface 1 to the substrate. A charging device 7 generates an electrostatic image on the photoconductive drum or surface 1.

The developing sleeve preferably rotates during the process. Rotation of the developing sleeve functions to evenly distribute toner onto the developing sleeve as the surface of the developing sleeve passes the doctor blade. Preferably, the developing sleeve has a resistance greater than about 10 M-Ohm (Meg-Ohm) between a developing sleeve shaft and a developing sleeve surface. In a preferred embodiment for non-magnetic bio-toner, the developing sleeve has a resistance greater than about 10 M-Ohm (Meg-Ohm) between a developing sleeve shaft and a developing sleeve surface. Preferably, a bias voltage on the developing sleeve shaft with respect to a ground level of an electrophotographic image forming device is in a range of from about 300 V (Volts) to about 1000 V (Volts) in absolute value. In a preferred embodiment for non-magnetic bio-toner, a bias voltage on the developing sleeve shaft with respect to a ground level of an electrophotographic image forming device is in a range of from about 300 V (Volts) to about 1000 V (Volts) in absolute value.

The doctor blade, or alternatively, the doctor bar, functions to evenly distribute the toner on the developing sleeve. For example, the toner may be deposited onto the developing sleeve by a toner cartridge or other device that places the toner onto the developing sleeve. The initial deposition of the toner on the developing sleeve may not evenly distribute the toner. For example, the toner may initially be deposited in a large amount on the developing sleeve. As the developing sleeve rotates through the toner, it picks up a surface covering of the toner. As the developing sleeve passes the doctor blade or doctor bar, excess amounts of the toner are removed and a layer of toner of desired thickness is distributed evenly on the surface of the developing sleeve. If the doctor blade is too soft, it may deform during use and lead to the uneven deposition of toner on the developing sleeve which consequently causes uneven distribution of toner in the printed images formed by the process. Defects such as shading and improper contrast may then be evident.

The doctor blade or doctor bar may or may not be in direct contact with the developing sleeve or the photoconductor of the image forming apparatus used in the process or method of the disclosure. The doctor blade or doctor bar may be spaced from the developing sleeve, such that a space forms between the developing sleeve and the doctor blade or doctor bar, and the distance between the doctor blade or doctor bar and the developing sleeve is the same or substantially the same across the entire width of the developing sleeve. In some embodiments, the doctor blade or doctor bar may be closer to or further away from the end sections of the developing sleeve if the end sections are not actively needed for transferring toner to the photoconductive drum.

The distance between the doctor blade or doctor bar and the developing sleeve may be adjusted to obtain the desired amount of toner deposition on the photoconductor. Such methods of adjusting the distance between the doctor blade or doctor bar and the developing sleeve are well known to those in the xerographic copying/printing art. For example, for each revolution of the developing sleeve, the doctor blade may be positioned to permit the passage of about 0.001-5.0 grams of toner per revolution, including all values and increments therein. For example, the doctor blade/developing sleeve may transfer from about 0.001 to about 2.0 grams per revolution onto the photoconductive drum depending on the image formed.

If the doctor blade or doctor bar has a hardness that is either too high or too low, inadequate electrostatic charges may form as the toner passes the doctor blade or doctor bar. Such inadequate electrostatic charges may distort the images formed by the process. For example, the inadequate electrostatic charges may result in ghosting and/or other image distortion phenomena.

The doctor blade preferably may have a hardness of 10-500 gf/mm (gram force per millimeter), more preferably 15-300 gf/mm, more preferably 100-200 gf/mm. When a suitable doctor blade is used with disclosed embodiments of magnetic bio-toner, preferably, the doctor blade has a hardness of about 10 gf/mm (gram force per millimeter) to about 35 gf/mm. When a suitable doctor blade is used with disclosed embodiments of non-magnetic bio-toner, preferably, the doctor blade has a hardness of about 10 gf/mm (gram force per millimeter) to about 500 gf/mm. All values between the stated values are expressly included herein as if explicitly written.

When a suitable doctor bar is used with disclosed embodiments of magnetic bio-toner, preferably, the doctor bar has a surface roughness (Ra) of about 0.3 μm (micrometers) to about 10 μm.

The doctor blade used in the disclosed methods may preferably be made of a thermoplastic material that has a high hardness and resists warpage and/or bending while concurrently showing little or no dimensional change caused by environmental changes in the conditions under which the process or method is carried out. Preferably, the doctor blade may be made of a thin metal blade with or without a plastic coating layer. In addition, the doctor blade may be made from a polymeric material such as a thermoplastic or thermoset type material. Accordingly, the doctor blade may be formed from thermoplastics including polyesters, polycarbonates, polysulphones, rigid vinyl (PVC), and other suitable thermoplastics. The doctor blade may also be formed from thermoplastic elastomers, including polyurethane, polyolefin or polyester type elastomers including: acrylonitrile butadiene styrene (ABS), acrylic (PMMA), celluloid cellulose acetate, ethylene-vinyl acetate (EVA), ethylene vinyl alcohol (EVOH), polytetrafluoroethylene (PTFE), polyacetal (POM), polyacrylates (Acrylic), polyacrylonitrile (PAN), polyamide (PA), polyamide-imide (PAI), polyaryletherketone (PAEK), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoates (PHAs), polyketone (PK), polyester, polyethylene (PE), polyetheretherketone (PEEK), polyetherketoneketone (PEKK), polyetherimide (PEI), polyethersulfone (PES), polyethylenechlorinate (PEC), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), or styrene-acrylonitrile (SAN), or another suitable thermoplastic elastomer material. The doctor blade may also be formed from a thermoset material such as a thermosetting polyester, vulcanized rubber, phenol-formaldehyde resin, urea-formaldehyde resin, melamine resin, epoxy resin, and/or polyimide, or another suitable thermoset material.

In contrast to the doctor blade, the wiper blade may be in direct contact with the photoconductive drum. The wiper blade serves to remove excess toner present on the surface of the photoconductive drum after an electrostatic image previously present on the photoconductive drum has been transferred to a substrate for subsequent fusing. The wiper blade is preferably made from a soft material that is unable to abraid the surface of the photoconductive drum.

The wiper blade preferably may have a hardness of 10-500 gf/mm (gram force per millimeter), more preferably 50-400 gf/mm, even more preferably 75-300 g/mm, and even more preferably 100-200 gf/mm. When a suitable wiper blade is used with disclosed embodiments of magnetic bio-toner, preferably, the wiper blade has a hardness of about 100 gf/mm (gram force per millimeter) to about 300 gf/mm. When a suitable wiper blade is used with disclosed embodiments of non-magnetic bio-toner, preferably, the wiper blade has a hardness of about 10 gf/mm (gram force per millimeter) to about 500 gf/mm. Preferably, the wiper blade material will not damage or actually remove or scrape material from the surface of the photoconductive drum. It is thus preferable that the wiper blade have a hardness that is lower than the hardness of the material present on the surface of the photoconductive drum. All values between the stated values are expressly included herein as if explicitly written.

The wiper blade desirably extends along nearly the entire length of the photoconductive drum and may include a plurality of portions (e.g., two or more portions) where each portion may be configured to engage with different or overlapping regions of the photoconductive drum. Thus, the wiper blade may comprise several sections that are laterally unconnected to one another. Accordingly, for a photoconductive drum having a given width, an unbroken section of the wiper blade may preferably extend 100%, preferably at least 95% or more of the width of the photoconductive drum, preferably at least 90% or more of the width of the photoconductive drum, or preferably at least 85% or more of the width of the photoconductive drum.

Further, the wiper blade may be imparted with a push type shear force vector to more effectively remove and/or scrape toner from the photoconductive drum surface. The wiper blade may further be imparted with a force vector by which the wiper blade may be forced to be in continuous contact with the photoconductive drum and thereby form a sealed-type joint between the photoconductive drum and the wiper blade. Shear force may result in the pushing of toner from the surface of the portion of the photoconductive drum that is in contact with the wiper blade at any given point in time. The shear force has a component vector that is perpendicular to the surface of the photoconductive drum and a component vector that is parallel to the radial and/or axial dimensions of the photoconductive drum.

The wiper blade used in the disclosed methods may be formed from a variety of materials. The wiper blade may be made from a polymeric material such as a thermoplastic or thermoset type material. Accordingly, the wiper blade may be formed from thermoplastics including polyesters, polycarbonates, polysulphones, rigid vinyl (PVC), and other suitable thermoplastics. The wiper blade may also be formed from thermoplastic elastomers, including polyurethane, polyolefin, or polyester type elastomers including: acrylonitrile butadiene styrene (ABS), acrylic (PMMA), celluloid cellulose acetate, ethylene-vinyl acetate (EVA), ethylene vinyl alcohol (EVOH), polytetrafluoroethylene (PTFE), polyacetal (POM), polyacrylates (acrylic), polyacrylonitrile (PAN), polyamide (PA), polyamide-imide (PAI), polyaryletherketone (PAEK), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoates (PHAs), polyketone (PK), polyester, polyethylene (PE), polyetheretherketone (PEEK), polyetherketoneketone (PEKK), polyetherimide (PEI), polyethersulfone (PES), polyethylenechlorinate (PEC), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), or styrene-acrylonitrile (SAN), or another suitable thermoplastic elastomer material. The wiper blade may also be formed from a thermoset material such as a thermosetting polyester, vulcanized rubber, phenol-formaldehyde resin, urea-formaldehyde resin, melamine resin, epoxy resin, and/or polyimide, or another suitable thermoset material.

Commercially available wiper blades and doctor blades, such as those manufactured by Kuroki of Taiwan, including the LP, LP-M, and LP-MC blades, may be used as the wiper blades and doctor blades in the process or method of the disclosure. Wiper blades and doctor blades or doctor bars in OEM (original equipment manufacturer) style can be obtained from suppliers such as Future Graphics Imaging Corporation of San Fernando, Calif. Preferred commercially available wiper blades and doctor blades may be made from polyurethane elastomer plastics, such as those obtained from aliphatic and cycloaliphatic isocyanates including 1,6-hexamethylene diisocyanate (HDI), 1-isocyanato-3-isocyanatomethyl-3,5,5-trimethyl-cyclohexane (isophorone diisocyanate, IPDI), and 4,4'-diisocyanato dicyclohexylmethane (H12MDI). Other aliphatic isocyanates may be included such as cyclohexane diisocyanate (CHDI), tetramethylxylene diisocyanate (TMXDI), and 1,3-bis(isocyanatomethyl)cyclohexane (H6XDI).

In another disclosed embodiment, there is provided a method of forming an image. The method comprises depositing one of the embodiments of a bio-toner, such as a non-magnetic bio-toner or a magnetic bio-toner, as discussed above, on the outer circumferential surface of an axially rotating developing sleeve to form a bio-toner covered developing sleeve. The method further comprises distributing the bio-toner over the circumferential surface of the bio-toner covered developing sleeve by contacting or placing in proximity thereto, the bio-toner present on the bio-toner covered developing sleeve with a doctor blade evenly spaced from the circumferential surface and across the width of the circumferential surface of the developing sleeve. Alternatively, a doctor bar may be used instead of a doctor blade. Preferably, a doctor blade or doctor bar can be used with embodiments of the non-magnetic bio-toner disclosed herein, and preferably, a doctor blade is used with embodiments of the magnetic bio-toner disclosed herein. The method further comprises contacting or placing in proximity thereto, the bio-toner present on the circumferential surface of the bio-toner covered developing sleeve with a photoconductive surface having a latent image formed by electrostatically charging the photoconductive surface to form a bio-toner image on the photoconductive surface. The method further comprises transferring the bio-toner image from the photoconductive surface to a substrate to form a printed image and fusing the printed image onto the substrate. The transferring and the fusing may occur at the same time. The method further comprises cleaning the surface of the photoconductive surface with a wiper blade to remove a bio-toner residue.

If a doctor blade is used, the doctor blade preferably has a hardness of about 10 gf/mm (gram force per millimeter) to about 35 gf/mm when used with embodiments of magnetic bio-toner disclosed herein, and preferably has a hardness of about 10 gf/mm to about 500 gf/mm when used with embodiments of non-magnetic bio-toner disclosed herein. If a doctor bar is used, such as with embodiments of non-magnetic bio-toner disclosed herein, the doctor bar preferably has a surface roughness (Ra) of about 0.3 μm (micrometers) to about 10 μm (micrometers) and more preferably, a surface roughness of about 0.5 μm (micrometers) to about 3 μm (micrometers). The wiper blade preferably has a hardness of about 100 gf/mm to about 300 gf/mm when used with embodiments of magnetic bio-toner disclosed herein. The wiper blade preferably has a hardness of about 10 gf/mm to about 500 gf/mm when used with embodiments of non-magnetic bio-toner disclosed herein.

For embodiments of magnetic bio-toner, an image density of a developed image using the bio-toner is preferably greater than about 1.4, and a background of a developed image using the bio-toner is preferably less than about 2.0. For embodiments of non-magnetic bio-toner, an image density of a developed image using the bio-toner is preferably greater than about 1.5, a background of a developed image using the bio-toner is preferably less than about 2.0, and a gloss of a developed image using the bio-toner is preferably greater than about 8, and more preferably, greater than about 10. Preferably, the developing sleeve has a resistance greater than about 10 M-Ohm (Meg-Ohm) between a developing sleeve shaft and a developing sleeve surface. Preferably, a bias voltage on a developing sleeve shaft with respect to a ground level of an electrophotographic image forming device is in a range of from about 300 V (Volts) to about 1000 V (Volts) in absolute value.

With regard to one or more embodiments of the method of forming an image, the preferred embodiments of the non-magnetic and magnetic bio-toners used in embodiments of the method are as discussed above. The foregoing description of several methods for making embodiments of the bio-toner of the disclosure and several methods for forming an image using embodiments of the bio-toner of the disclosure have been presented for purposes of illustration. It is not intended to be exhaustive or to limit the disclosure to precise steps and/or forms disclosed, and obviously many modifications and variations are possible in light of the above teachings. It is intended that the scope of the disclosed embodiments be defined by the claims appended hereto.

EXAMPLES

In order to demonstrate the effect of one or more embodiments of the disclosure, the following non-limiting experiments were carried out.

Non-Magnetic Bio-Toner Examples

FIG. 2A illustrates a table that shows the compositions of non-magnetic bio-toners for Examples 1-5 and Comparative Example 1. FIG. 2B shows the experimental conditions for printing experiments conducted with the non-magnetic bio-toners of Examples 1-5 and Comparative Example 1, and further shows the results of experiments relating to print quality properties using the non-magnetic bio-toners of Examples 1-5 and Comparative Example 1.

The hardness of wiper blades and doctor blades was measured by mounting a blade into a movable fixture. The fixture and blade were then moved towards a fixed force gauge, until the edge of the blade just touched the gauge. The amount of force was recorded (and the gauge was set to zero). Then, the fixture was moved by 1 mm (millimeter), towards the force gauge, and the force was recorded by the force gauge. The total force was divided by the distance the blade was moved during the test to give a hardness measurement in grams of force per millimeter. A harder blade provides a relatively higher measure of force per millimeter than a softer blade. The surface roughness (Ra) of doctor bars was measured by POCKET SURF III analytical device from Mahr Federal, Inc. of Providence, R.I. (POCKET SURF is a registered trademark of Mahr Federal Inc. of Providence, R.I.)

Bio-toners were prepared by first preparing pre-mix formulations.

Example 1

A first pre-mix formulation contained: 100 parts by weight (88% by weight) of a bio-resin HRJ16062-C obtained from Advanced Image Resources of Alpharetta, Ga.; 8 parts by weight of a colorant in the form of Mogul-L carbon black (CB) from Cabot Corporation of Boston, Mass.; 2.5 parts by weight of a wax in the form of WE3, an ester-type wax, from NOF Corporation of Japan; and, 1.5 parts by weight of a charge control agent (CCA) in the form of E81, a salicylic acid, from Orient Chemical Industries, Co., Ltd. of Japan, where the percent by weight was based on the total weight of the bio-resin, the colorant, the wax, and the charge control agent. The resin component comprised 100 parts bio-resin and zero parts second resin.

Example 2

A second pre-mix formulation contained: 100 parts by weight (87.5% by weight) of a bio-resin HRJ16062-C obtained from Advanced Image Resources of Alpharetta, Ga.; 8 parts by weight of a colorant in the form of Mogul-L carbon black (CB) from Cabot Corporation of Boston, Mass.; 2.5 parts by weight of a wax in the form of WE3, an ester-type wax, from NOF Corporation of Japan; and, 2.0 parts by weight of a charge control agent (CCA) in the form of DLN-32CW, an azo type dye, from Hubei Dinglong Chemical Co., Ltd. of Wuhan, China, where the percent by weight was based on the total weight of the bio-resin, the colorant, the wax, and the charge control agent. The resin component comprised 100 parts bio-resin and zero parts second resin.

Example 3

A third pre-mix formulation contained: 100 parts by weight (87.5% by weight) of a bio-resin HRJ16062-C obtained from Advanced Image Resources of Alpharetta, Ga.; 8 parts by weight of a colorant in the form of Mogul-L carbon black (CB) from Cabot Corporation of Boston, Mass.; 2.5 parts by weight of a wax in the form of WE3, an ester-type wax, from NOF Corporation of Japan; and, 2.0 parts by weight of a charge control agent (CCA) in the form of E84, a salicylic acid, from Orient Chemical Industries, Co., Ltd. of Japan, where the percent by weight was based on the total weight of the bio-resin, the colorant, the wax, and the charge control agent. The resin component comprised 100 parts bio-resin and zero parts second resin.

Example 4

A fourth pre-mix formulation contained: 100 parts by weight (88% by weight) of a bio-resin HRJ16062-C obtained from Advanced Image Resources of Alpharetta, Ga.; 8 parts by weight of a colorant in the form of Mogul-L carbon black (CB) from Cabot Corporation of Boston, Mass.; 2.5 parts by weight of a wax in the form of WE3, an ester-type wax, from NOF Corporation of Japan; and, 1.5 parts by weight of a charge control agent (CCA) in the form of E81, a salicylic acid, from Orient Chemical Industries, Co., Ltd. of Japan, where the percent by weight was based on the total weight of the bio-resin, the colorant, the wax, and the charge control agent. The resin component comprised 100 parts bio-resin and zero parts second resin.

Example 5

A fifth pre-mix formulation contained: 70 parts by weight (61.6% by weight) of a bio-resin HRJ 16062-C obtained from Advanced Image Resources of Alpharetta, Ga.; 30 parts by weight (26.4% by weight) of a second resin MC400/500 obtained from Sanyo Chemical Industries Ltd. of Japan; 8 parts by weight of a colorant in the form of Mogul-L carbon black (CB) from Cabot Corporation of Boston, Mass.; 2.5 parts by weight of a wax in the form of WE3, an ester type wax, from NOF Corporation of Japan; and, 1.5 parts by weight of a charge control agent (CCA) in the form of E81, a salicylic acid, from Orient Chemical Industries, Co., Ltd. of Japan, where the percent by weight was based on the total weight of the bio-resin, the colorant, the wax, and the charge control agent. The resin component comprised the bio-resin HRJ16062-C which was present in an amount of 70 parts by weight and the second resin MC 400/500 which was present in an amount of 30 parts by weight, based on the total parts by weight of the bio-resin and the second resin.

Each of the pre-mix formulations was separately subjected to mixing in a 40 liter Henschel mixer (manufactured by Mitsui Mining Co., Ltd. of Japan) at 1,000 rpm (revolutions per minute) for 5 minutes to each form a bio-resin mixture.

Each of the bio-resin mixtures was then separately kneaded in a Werner & Pfleiderer twin screw extruder, Model ZSK-30 (manufactured by Werner & Pfleiderer Corporation of Ramsey, N.J.) at a screw speed of 250 rpm (revolutions per minute) and a kneading barrel set temperature in the extruder of 110° C. (degrees Celsius) to form an extruded bio-resin mixture. Each of the extruded bio-resin mixtures was cooled, then each was pulverized to form a pulverized bio-resin mixture, and then each was classified.

Each of the classified bio-resin mixtures was then used to prepare a bio-toner composition based on 100 parts or 100% by weight of the classified bio-resin mixture or bio-resin/second resin mixture. The following additive components were added to each of the classified bio-resin mixtures in a first stage of a post-mixing process: silicon carbide (SiC) particles (HSC059N from Superior Graphite of Chicago, Ill.) were included in an amount of 0.25 parts; large size silicon dioxide ($SiO_2$) particles (TG-C6020N from Cabot Corporation of Boston, Mass.) were included in an amount of 0.9 parts; and, titanium dioxide ($TiO_2$) particles (FLT-100 from Ishihara Corporation USA of San Francisco, Calif.) were included in an amount of 0.25 parts.

The following additive component was added to each of the classified bio-resin mixtures in a second stage post-mixing process: small size silicon dioxide ($SiO_2$) particles (TG-308F from Cabot Corporation of Boston, Mass.) were included in an amount of 0.3 parts.

The first stage of post-mixing each of the classified bio-resin mixtures to form each of the bio-toner compositions was carried out in a 10 liter Henschel mixer at 3400 rpm (revolutions per minute) for 10 minutes. The second stage of post-mixing each of the classified bio-resin mixtures to form each of the bio-toner compositions was carried out in a 10 liter Henschel mixer at 3400 rpm (revolutions per minute) for 6 minutes.

The bio-toner compositions were then each sieved or strained through a 150 mesh sieve. The bio-based content of each of the bio-toner compositions for Examples 1-4 was 53% according to ASTM-D6866. The bio-based content of the bio-toner composition for Example 5 was 37% according to ASTM-D6866. The bio-based content of the bio-toner composition for Comparative Example 1 was 55% according to ASTM-D6866.

The classified material of Example 1 bio-toner had a median particle size (D50) of 8.9 μm (micrometers). The classified material of Example 2 bio-toner had a median particle size (D50) of 8.7 μm (micrometers). The classified material of Example 3 bio-toner had a median particle size (D50) of 9.1 μm (micrometers). The classified material of Example 4 bio-toner had a median particle size (D50) of 8.9 μm (micrometers). The classified material of Example 5 bio-toner had a median particle size (D50) of 8.8 μm (micrometers). The classified material of Comparative Example 1 bio-toner had a median particle size (D50) of 9.0 μm (micrometers). The resulting classified material of Example 1-5 and Comparative Example 1 bio-toners had a fraction of particles less than 5 μm (micrometers) of less than 4% by volume. A Multisizer 3 COULTER COUNTER particle sizing and counting analyzer from Beckman Coulter, Inc. of Fullerton, Calif., was used to measure particle size distribution. (COULTER COUNTER is a registered trademark of Beckman Coulter, Inc. of Fullerton, Calif.)

Each of the compositions of bio-toners of Examples 1-5 and Comparative Example 1 was dispersed in MeOH (methanol) and each of the bio-toners' visible UV (ultra-violet) absorption was measured. The absorption in MeOH (methanol) for Example 1 bio-toner had an absorption peak at 310 nm (nanometers). The absorption for Example 2 bio-toner had an absorption peak at 570 nm (nanometers). The absorption for Example 3 bio-toner had an absorption peak at 310 nm (nanometers). The absorption for Example 4 bio-toner had an absorption peak at 310 nm (nanometers). The absorption for Example 5 bio-toner had an absorption peak at 310 nm (nanometers). The absorption for Comparative Example 1 bio-toner had an absorption peak at 310 nm (nanometers).

Each of the compositions of bio-toners of Examples 1-5 and Comparative Examples 1 had a DSC (differential scanning calorimetry) peak temperature of 70 degrees Celsius.

The table of FIG. 2B shows the experimental conditions for printing experiments conducted with the non-magnetic bio-toners of Examples 1-5, and Comparative Example 1, and the results of experiments relating to print quality properties using the non-magnetic bio-toners of Examples 1-5 and Comparative Example 1. Printing tests on Example 1-3 and 5 and Comparative Example 1 bio-toners were conducted using Lexmark T644 laser printers (manufactured by Lexmark International Inc., of Lexington, Ky.). For Examples 1-3 and 5 and Comparative Example 1, the printer cartridge used was an OEM (original equipment manufacturer) cartridge; the wiper blade used was FGIC T640 WBLADEK obtained from Future Graphics Imaging Corporation of San Fernando, Calif., and the wiper blade had a 117 gf/mm (gram-force per millimeter) work force; the OPC (organic photoconductive drum) used was FGIC T640 MKIPNPE obtained from Future Graphics Imaging Corporation of San Fernando, Calif.; the doctor bar used was an OEM doctor bar having a surface roughness average (Ra) of 1.3 μm (micrometers); and the developer roller used was an OEM developer roller (sleeve)

having a 2,200 M-Ohm (Meg-Ohm) resistance between a developing sleeve (metal) shaft and a developer roller surface, when a voltage of 1,000 V and a pressure of 2,140 g (gram) is applied to the roller surface over the contact area of 8 square millimeters. The bias voltage with respect to the ground level on the developer roller shaft was −643 V (volts). The printing test for each bio-toner was a life test conducted until the bio-toner ran out. The printing was conducted in an environment at a temperature of about 23° C. (Celsius) and at a relative humidity (RH) of about 30%-40%.

Printing tests on Example 4 bio-toner were conducted using a Samsung ML-1710 laser printer (manufactured by Samsung USA of Ridgefield Park, N.J.). For Example 4, the printer cartridge used was an OEM (original equipment manufacturer) cartridge; no wiper blade was used; the OPC (organic photoconductive drum) used was an OEM; the doctor blade used was an OEM doctor blade having a 175 gf/mm (gram-force per millimeter) work force; and the developer roller used was an OEM developer roller having a 42 (Meg-Ohm) resistance between a developing sleeve shaft and a developer roller surface, when a voltage of 1,000 V and a pressure of 2,140 g (gram) is applied to the roller surface over the contact area of 8 square millimeters. The bias voltage with respect to the ground level on the developer roller shaft was −345 V (volts). The printing test for the bio-toner was a life test conducted until the bio-toner ran out. The printing was conducted in an environment at a temperature of about 23° C. (Celsius) and at a relative humidity (RH) of about 30%-40%.

The table of FIG. 2B further shows the results of printing experiments relating to print quality properties using the non-magnetic bio-toners of Examples 1-5 and Comparative Example 1. The print quality properties tested for Examples 1-5 and Comparative Example 1 included measuring image density (ID), background (BG), gloss, fixing, and offset.

The image density (ID) print quality property of the bio-toners of Examples 1-5 and Comparative Example 1 was tested. The ID was calculated as $-\log_{10}(I/I_0)$, where $I_0$ is the intensity of the incident light and I is the intensity of the reflected light. The ID was measured using a MACBETH RD914 reflection densitometer device (manufactured by Gretag Macbeth Holding AG Corporation of Switzerland). (MACBETH is a registered trademark of Gretag Macbeth Holding AG Corporation of Switzerland.) The ID was measured at Zero Pages and at 9000 Pages of printing. The ID of Example 1 bio-toner was 1.63 at Zero Pages and 1.58 at 9000 Pages. The ID of Example 2 bio-toner was 1.51 at Zero Pages no measurement was taken at 9000 Pages. The ID of Example 3 bio-toner was 1.52 at Zero Pages and no measurement was taken at 9000 Pages. The ID of Example 4 bio-toner was 1.33 at Zero Pages and no measurement was taken at 9000 Pages. The ID of Example 5 bio-toner was 1.57 at Zero Pages and 1.56 at 9000 Pages. The ID of Comparative Example 1 bio-toner was 1.65 at Zero Pages and no measurement was taken at 9000 Pages.

The background (BG) print quality property of the bio-toners of Examples 1-5 and Comparative Example 1 was tested. The BG was measured using a whiteness meter (manufactured by Nippon Denshoku Industries Co., Ltd. of Japan), as the average value over the life of the test, wherein the difference in the whiteness (WB) value in the non-image area before and after the printing process is shown as the BG value. The smaller the BG value, the more desirable the image is. The BG was measured at Zero Pages and at 9000 Pages of printing. The BG of Example 1 bio-toner was 0.7 at Zero Pages and 1.7 at 9000 Pages. The BG of Example 2 bio-toner was 1.2 at Zero Pages and no measurement was taken at 9000 Pages. The BG of Example 3 bio-toner was 0.8 at Zero Pages and no measurement was taken at 9000 Pages. The BG of Example 4 bio-toner was 2.4 at Zero Pages and no measurement was taken at 9000 Pages. The BG of Example 5 bio-toner was 0.8 at Zero Pages and 0.6 at 9000 Pages. The BG of Comparative Example 1 bio-toner was 0.9 at Zero Pages and no measurement was taken at 9000 pages.

The gloss print quality property of the bio-toners of Examples 1-3 was tested. Gloss of the solid image area printed on a white sheet of paper with the bio-toners of Examples 1-3 was measured by using a gloss meter VG-2000 (manufactured by Nippon Denshoku Industries Co., Ltd. of Japan) according to JIS Z 8741 at the angle of 75 degrees. The gloss of Example 1 bio-toner was 11.2. The gloss of Example 2 bio-toner was 10.7. The gloss of Example 3 bio-toner was 11.6. The gloss of Example 4 bio-toner was 5.0. The gloss of Example 5 and Comparative Example 1 bio-toner was not tested.

The fixing print quality property of the bio-toners of Examples 1-5 and Comparative Example 1 was tested. Fixing of the bio-toners of Examples 1-5 and Comparative Example 1 was tested using a tape peel test. The tape used for the measurements was 3M Scotch tape, 18 mm (millimeters) wide, from 3M Company of Minneapolis, Minn. After using one of the laser printers discussed above and one of the bio-toners of Examples 1-5 and Comparative Example 1 to produce a fused image or print on the paper, the tape was attached to the fused image or print on the paper by a controlled and repeatable pressure. Then the tape was pulled back from the paper by a controlled and repeatable force, speed, and angle. The fixing for Example 1 was 92%. The fixing for Example 2 was 93%. The fixing for Example 3 was 90%. The fixing for Example 4 was not measured. The fixing for Example 5 was 95%. The fixing for Comparative Example 1 was 94%. The percentage of fixing for the Examples represents the ratio of the ID (image density) after the tape was peeled to the ID (image density) before the tape was peeled. The printed images were visually inspected for any damage, e.g., toner lifting, dots, and the like, and the results were that minimal damage was visually seen.

The offset print quality property of the bio-toners of Examples 1-5 and Comparative Example 1 was tested. The offset was determined by visual inspection. The offset for Examples 1-4 was "Slight". The offset for Example 5 was "None". The offset for Comparative Example 1 was "NG" which means "No Good" and offsetting was observed.

The bio-resins used in Examples 1-5 and Comparative Example 1 were made in accordance with the methods described in US 2008/0145775 and US 2007/0015175, each of which is incorporated herein by reference in its entirety, using monomer mixtures that contained 2% by weight of trimethylol propane (TMP) as a cross-linking monomer; Floradyme 1100, Pripol 1013, and 1,4-cyclohexane dicarboxylic acid (CHDA) as di-acid monomer units; and isosorbide as the diol monomer unit. The mixture of monomer units was subjected to polymerization in the presence of a sodium acetate catalyst 0.02% by weight to form the bio-resins. The relative proportion of monomer units in the bio-resin HRJ16062-C was as follows (values are provided in weight % based on the total weight of the bio-resin): TMP 2%, CHDA 39.5%, Floradyme 1100 18%, isosorbide (98% pure) 39.5%, Pripol 1013 1%, by weight.

Softening point (Sp) was measured using a capillary rheometer flow tester (CFT-500, constant-pressure extrusion system, manufactured by Shimadzu Corporation of Japan) as a temperature at the middle point of a strand from the initiation to the completion of the flow when 1.0 g (gram) of a sample was measured by a flow tester (CFT-500, manufactured by Shimadzu Corporation of Japan) with a nozzle of 1 mm×10 mm (millimeters) under conditions such that the load was 30 kg (kilograms), the preheating time was 5 minutes at 50° C. (degrees Celsius) and the temperature raising rate was 3° C./minute. Softening point was preferably measured with a precision of ±2° C. The softening point (Sp) for the resin 1 bio-resin of each of the formulations of Examples 1-5 was 132.4° C. The softening point (Sp) for the resin 1 bio-resin of the formulation of Comparative Example 1 was 128° C. The softening point (Sp) for the resin 2 of the formulation of Example 5 was 127° C.

The preferred non-magnetic bio-toner composition or formulation, as shown in FIG. 2A and as discussed above, is Example 5.

Magnetic Bio-Toner Examples

FIG. 3A illustrates a table that shows the compositions of magnetic bio-toners for Examples 1-11 and Comparative Examples 1-5. FIG. 3B shows the experimental conditions for printing experiments conducted with the magnetic bio-toners of Examples 1-11 and Comparative Examples 1-5. FIG. 3B further shows the results of experiments relating to print quality properties using the magnetic bio-toners of Examples 1-11 and Comparative Examples 1-5.

The hardness of wiper blades and doctor blades was measured by mounting a blade into a movable fixture. The fixture and blade were then moved towards a fixed force gauge, until the edge of the blade just touched the gauge. The amount of force was recorded (and the gauge was set to zero). Then, the fixture was moved by 1 mm (millimeter), towards the force gauge and the force was recorded by the force gauge. The total force was divided by the distance the blade was moved during the test to give a hardness measure in grams of force per millimeter. A harder blade provides a relatively higher measure of force per millimeter than a softer blade. The surface roughness (Ra) of doctor bars was measured by POCKET SURF III analytical device from Mahr Federal, Inc. of Providence, R.I. (POCKET SURF is a registered trademark of Mahr Federal Inc. of Providence, R.I.)

Magnetic bio-toners were prepared by first preparing premix formulations for Examples 1-11 and Comparative Examples 1-5. Each of the premix formulations for Examples 1-9 and Comparative Examples 1-5 contained two waxes, including: (a) 2.5 parts by weight of a wax in the form of WE3, an ester-type wax, obtained from NOF Corporation of Japan; and (b) 1.5 parts by weight of a wax in the form of Ceridust 5551 (C5551), a hydrocarbon-type wax comprising a low molecular weight polyethylene obtained from Clariant of Coventry, R.I. The premix formulation for Example 10 contained: (a) 8 parts by weight of a wax in the form of WE10, an ester-type wax, obtained from NOF Corporation of Japan; and (b) 1.5 parts by weight of wax in the form of Ceridust 5551 (C5551) obtained from Clariant of Coventry, R.I. The premix formulation for Example 11 contained 10 parts by weight of a wax in the form of P110, a low molecular weight polyethylene wax obtained from Clariant of Coventry, R.I. Each of the pre-mix formulations for Examples 1-11 and Comparative Examples 1-5 further contained 90 parts by weight (46% by weight) of a magnetic powder RH69P obtained from Toda Kogyo Corp. of Japan. Each of the premix formulations for Examples 1-11 and Comparative Examples 1-5 further contained 1 part by weight of a charge control agent TRH obtained from Hodogaya Chemical Co., Ltd. of Japan. Each of the pre-mix formulations for Examples 1-11 and Comparative Examples 4-5 further contained a balance by parts by weight (and weight %) of a mixture of a bio-resin and a second petroleum-based resin, based on the total weight of the waxes, magnetic powder, charge control agent, and mixture of bio-resin and second petroleum resin. Examples 1, 7-9, and Comparative Example 5 further contained 42 ppm (parts per million) of cobalt contents, and Example 11 further contained 39 ppm (parts per million) of cobalt contents. Measurement of the cobalt contents was taken using the following procedure: (1) digestion of the toner sample with concentrated sulfuric acid, (2) ashing of the toner sample at 500 degrees Celsius, (3) dissolution of the toner sample in hydrochloric acid and nitric acid, and (4) determination of the cobalt contents in the toner sample by ICP-AES emission spectrophotometric technique.

The mixture of the bio-resin and the second petroleum-based resin was based on 100 parts by weight of the total parts by weight of the bio-resin and the second petroleum-based resin. The second petroleum-based resin in Examples 1-9 and Comparative Example 5 was a mixture of polyester polymers MC400 and MC500 obtained from Sanyo Chemical Industries Ltd. of Japan. The second petroleum-based resin in Examples 10-11 was MC500 obtained from Sanyo Chemical Industries Ltd. of Japan. The second petroleum-based resin in Comparative Example 4 was polyester resin ET2900 obtained from SK Chemicals of Korea. As shown in FIG. 3A, Examples 1-4 and 7-11 contained 70 parts by weight bio-resin and 30 parts by weight of the second petroleum-based resin, based on the total weight percent of the resin 1 bio-resin and the resin 2 petroleum-based resin. Example 5 contained 40 parts by weight bio-resin and 60 parts by weight of the second petroleum-based resin, based on the total weight percent of the resin 1 bio-resin and the resin 2 petroleum-based resin. Example 6 contained 7 parts by weight bio-resin and 93 parts by weight of the second petroleum-based resin, based on the total weight percent of the resin 1 bio-resin and the resin 2 petroleum-based resin. Comparative Examples 1-3 contained 100 parts by weight bio-resin and 0 parts by weight of the second petroleum-based resin, based on the total weight percent of the resin 1 bio-resin and the resin 2 petroleum-based resin. Comparative Example 4 contained 80 parts by weight bio-resin and 20 parts by weight of the second petroleum-based resin, based on the total weight percent of the resin 1 bio-resin and the resin 2 petroleum-based resin. Comparative Example 5 contained 70 parts by weight bio-resin and 30 parts by weight of the second petroleum-based resin, based on the total weight percent of the resin 1 bio-resin and the resin 2 petroleum-based resin.

Each of the pre-mix formulations was separately subjected to mixing in a 40 liter Henschel mixer (manufactured by Mitsui Mining Co., Ltd. of Japan) at 1,000 rpm (revolutions per minute) for 4 minutes to each form a bio-resin mixture.

Each of the bio-resin mixtures was then separately kneaded in a Werner & Pfleiderer twin screw extruder, Model ZSK-30 (manufactured by Werner & Pfleiderer Corporation of Ramsey, N.J.), at a screw speed of 250 rpm (revolutions per minute) and a kneading barrel set temperature in the extruder of 125° C. (degrees Celsius) for Examples 1-9 and Comparative Examples 1-5, and a kneading barrel set temperature in the extruder of 130° C. (degrees Celsius) for Examples 10-11, to form an extruded bio-resin mixture. Each of the extruded bio-resin mixtures was cooled, then each was pulverized to form a pulverized bio-resin mixture, and then each was classified.

Each of the classified bio-resin mixtures was then used to prepare a bio-toner composition based on 100 parts or 100% by weight of the classified bio-resin mixture. The following additive components were added to the classified bio-resin mixtures in a first stage of a post-mixing process: large size silica ($SiO_2$) particles (H05TD from Clariant of Conventry, R.I.) was included in an amount of 0.35 parts; magnetite (EPT1002 from Toda Kogyo Corp. of Japan) was included in an amount of 0.7 parts; and zinc stearate (DLG20A from Ferro Corporation of Cleveland, Ohio) was included in an amount of 0.05 parts.

The following additive component was added to each of the classified bio-resin mixtures in a second stage post-mixing process: small size silica ($SiO_2$) particles (VP RY200L2 from Evonik Industries AG of Germany) was included in an amount of 1.15 parts.

The first stage of post-mixing each of the classified bio-resin mixtures to form each of the bio-toner compositions was carried out in a 10 liter Henschel mixer at 2,300 rpm (revolutions per minute) for 3 minutes. The second stage of post-mixing was carried out in a 10 liter Henschel mixer at 1,750 rpm for 6 minutes.

The bio-toner compositions were then each sieved or strained through a 150 mesh sieve. The bio-based content of each of the bio-toner compositions for Examples 1, and 7-9 and Comparative Example 5 was 42% according to ASTM-D6866. The bio-based content of each of the bio-toner composition for Comparative Examples 1 was 57% according to ASTM-D6866.

The classified material of Example 1 bio-toner had a median particle size (D50) of 8.3 μm (micrometers). The classified material of Example 2 bio-toner had a median particle size (D50) of 8.2 μm (micrometers). The classified material of Example 3 bio-toner had a median particle size (D50) of 8.4 μm (micrometers). The classified material of Example 4 bio-toner had a median particle size (D50) of 8.4 μm (micrometers). The classified material of Example 5 bio-toner had a median particle size (D50) of 8.3 μm (micrometers). The classified material of Example 6 bio-toner had a median particle size (D50) of 8.1 μm (micrometers). The classified material of Example 7 bio-toner had a median particle size (D50) of 8.3 μm (micrometers). The classified material of Example 8 bio-toner had a median particle size (D50) of 8.3 μm (micrometers). The classified material of Example 9 bio-toner had a median particle size (D50) of 8.3 μm (micrometers). The classified material of Example 10 bio-toner had a median particle size (D50) of 8.2 μm (micrometers). The classified material of Example 11 bio-toner had a median particle size (D50) of 8.2 μm (micrometers). The classified material of Comparative Example 1 bio-toner had a median particle size (D50) of 8.4 μm (micrometers). The classified material of Comparative Example 2 bio-toner had a median particle size (D50) of 8.2 μm (micrometers). The classified material of Comparative Example 3 bio-toner had a median particle size (D50) of 8.3 μm (micrometers). The classified material of Comparative Example 4 bio-toner had a median particle size (D50) of 8.1 μm (micrometers). The classified material of Comparative Example 5 bio-toner had a median particle size (D50) of 8.3 μm (micrometers). The resulting classified material of Example 1-11 and Comparative Example 1-5 bio-toners had a median particle size (D50) of 8.2 μm (micrometers). The resulting classified material of all Examples of bio-toners had a fraction of particles less than 5 μm (micrometers) of less than 5% by volume. A Multisizer 3 COULTER COUNTER particle sizing and counting analyzer from Beckman Coulter, Inc. of Fullerton, Calif., was used to measure particle size distribution. (COULTER COUNTER is a registered trademark of Beckman Coulter, Inc. of Fullerton, Calif.)

Each of the compositions of bio-toners of Examples 1-11 and Comparative Examples 1-5 was dispersed in MeOH (methanol) and each of the bio-toners' visible UV (ultraviolet) absorption was measured. The absorption in MeOH (methanol) for all Examples 1-11 and Comparative Examples 1-5 had an absorption peak at 578 nm (nanometers).

Each of the compositions of bio-toners of Examples 1-9 and Comparative Examples 1-5 had a DSC (differential scanning calorimetry) peak temperature of 72 degrees Celsius. The composition of the bio-toner of Example 10 had a DSC (differential scanning calorimetry) peak temperature of 71 degrees Celsius. The composition of the bio-toner of Example 11 had a DSC (differential scanning calorimetry) peak temperature of 96 degrees Celsius.

The table of FIG. 3B also shows the experimental conditions for printing experiments conducted with the bio-toners of Examples 1-11 and Comparative Examples 1-5, and the results of experiments relating to print quality properties using the bio-toners of Examples 1-11 and Comparative Examples 1-5.

Printing tests on Example 1-6, and 9-11 bio-toners and Comparative Examples 1-5 bio-toners were conducted using HP 4250 laser printers (manufactured by Hewlett-Packard Company of Palo Alto, Calif.). Printing tests on Example 7 bio-toner were conducted using HP P2015 laser printer (manufactured by Hewlett-Packard Company of Palo Alto, Calif.). Printing tests on Example 8 bio-toner was conducted using HP 1012 laser printer (manufactured by Hewlett-Packard Company of Palo Alto, Calif.). For Examples 1-11 and Comparative Examples 1-5, the printer cartridge used was a remanufactured cartridge.

For Examples 1-6 and Comparative Examples 1-5, the doctor blade used was an OEM with 20.6 gf/mm (gram-force per millimeter) work force. For Example 7 the doctor blade used was an OEM with 23.0 gf/mm (gram-force per millimeter) work force. For Examples 8 and 10-11, the doctor blade used was an OEM with 18.5 gf/mm (gram-force per millimeter) work force. For Example 9, the doctor blade used was obtained from Kuroki of Taiwan and had 24.5 gf/mm (gram-force per millimeter) work force.

For Examples 1-6 and Comparative Examples 1-4, the wiper blade used was an OEM with 235 gf/mm (gram-force per millimeter) work force. For Example 7 the wiper blade used was an OEM with 253 gf/mm (gram-force per millimeter) work force. For Examples 8 and 10-11, the wiper blade used was an OEM with 215 gf/mm (gram-force per millimeter) work force. For Example 9, the wiper blade used was obtained from Kuroki of Taiwan and had 241 gf/mm (gram-force per millimeter) work force. For Comparative Example 5, the wiper blade used was a sample trial wiper blade and had 125 gf/mm (gram-force per millimeter) work force.

For Examples 1-11 and Comparative Examples 1-5, the OPC (organic photoconductive drum) used was HP1160MKIHDPNPE for Example 7, HP1012MKIPNPE for Example 8, and HP4200MKILPNPE for Examples 1-6 and 9-11 and Comparative Examples 1-5, all obtained from Future Graphics Imaging Corporation of San Fernando, Calif. The doctor bar used was an OEM doctor bar. The developer roller (sleeve) used was an OEM developer roller (sleeve).

Printing was carried out at a printing speed of 30-32 documents/minute. The printing test for each bio-toner was a life test conducted until the bio-toner ran out. The printing was conducted in an environment at a temperature of about 23° C. (Celsius) and at a relative humidity (RH) of about 30%-40%.

The table of FIG. 3B shows the results of printing experiments relating to print quality properties using the bio-toners of Examples 1-11 and Comparative Examples 1-5. The print quality properties tested for Examples 1-11 and Comparative Examples 1-5 included measuring image density (ID), background (BG), fixing, offset, and "Others" such as flipping.

The image density (ID) print quality property of the bio-toners of Examples 1-11 and Comparative Examples 1-4 was tested. The ID was calculated as $-\log_{10}(I/I_0)$, where $I_0$ is the intensity of the incident light and I is the intensity of the reflected light. The ID was measured at Zero Pages using a MACBETH RD914 reflection densitometer device (manufactured by Gretag Macbeth Holding AG Corporation of Switzerland). (MACBETH is a registered trademark of Gretag Macbeth Holding AG Corporation of Switzerland.) The ID of Example 1 bio-toner was 1.56. The ID of Example 2 bio-toner was 1.5. The ID of Example 3 bio-toner was 1.53. The ID of Example 4 bio-toner was 1.48. The ID of Example 5 bio-toner was 1.49. The ID of Example 6 bio-toner was 1.47. The ID of Example 7 bio-toner was 1.42. The ID of Example 8 bio-toner was 1.45. The ID of Example 9 bio-toner was 1.56. The ID of Example 10 bio-toner was 1.57. The ID of Example 11 bio-toner was 1.54. The ID of Comparative Example 1 bio-toner was 1.56. The ID of Comparative Example 2 bio-toner was 1.51. The ID of Comparative Example 3 bio-toner was 1.59. The ID of Comparative Example 4 bio-toner was 1.51. The ID of Comparative Example 5 bio-toner was not measured.

The background (BG) print quality property of the bio-toners of Examples 1-11 and Comparative Examples 1-4 was tested. The BG was measured using a whiteness meter (manufactured by Nippon Denshoku Industries Co., Ltd. of Japan), as the average value over the life of the test, wherein the difference in the whiteness (WB) value in the non-image area before and after the printing process is shown as the BG value. The smaller the BG value, the more desirable the image is. The BG of Example 1 bio-toner was 1.23. The BG of Example 2 bio-toner was 0.96. The BG of Example 3 bio-toner was 1.11. The BG of Example 4 bio-toner was 1.25. The BG of Example 5 bio-toner was 0.72. The BG of Example 6 bio-toner was 0.61. The BG of Example 7 bio-toner was 0.51. The BG of Example 8 bio-toner was 0.91. The BG of Example 9 bio-toner was 0.78. The BG of Example 10 bio-toner was 0.85. The BG of Example 11 bio-toner was 0.78. The BG of Comparative Example 1 bio-toner was 1.15. The BG of Comparative Example 2 bio-toner was 1.12. The BG of Comparative Example 3 bio-toner was 1.07. The BG of Comparative Example 4 bio-toner was 0.82. The BG of Comparative Example 5 bio-toner was not measured.

The fixing print quality property of the bio-toners of Examples 1-11 and Comparative Examples 1-4 was tested. Fixing of the bio-toners of Examples 1-11 and Comparative Examples 1-4 was tested using a tape peel test. The tape used for the measurements was 3M Scotch tape, 18 mm (millimeters) wide, from 3M Company of Minneapolis, Minn. After using one of the laser printers discussed above and one of the bio-toners of Examples 1-11 and Comparative Examples 1-4 to produce a fused image or print on the paper, the tape was attached to the fused image or print on the paper by a controlled and repeatable pressure. Then the tape was pulled back from the paper by a controlled and repeatable force, speed, and angle. The fixing was measured using the tape peel test as the ratio of ID before and after peeling as a percentage %. The fixing of Example 1 bio-toner was 95%. The fixing of Example 2 bio-toner was 95%. The fixing of Example 3 bio-toner was 92%. The fixing of Example 4 bio-toner was 89%. The fixing of Example 5 bio-toner was 95%. The fixing of Example 6 bio-toner was 98%. The fixing of Example 7 bio-toner was 94%. The fixing of Example 8 bio-toner was 96%. The fixing of Example 9 bio-toner was 95%. The fixing of Example 10 bio-toner was 98%. The fixing of Example 11 bio-toner was 98%. The fixing of Comparative Example 1 bio-toner was 78%. The fixing of Comparative Example 2 bio-toner was 88%. The fixing of Comparative Example 3 bio-toner was 52%. The fixing of Comparative Example 4 bio-toner was 72%. The fixing of Comparative Example 5 bio-toner was not measured. The percentage of fixing for the Examples represents the ratio of the ID (image density) after the tape was peeled to the ID (image density) before the tape was peeled. The printed images were visually inspected for any damage, e.g., toner lifting, dots, and the like, and the results were that minimal damage was visually seen.

The offset print quality property of the bio-toners of Examples 1-11 and Comparative Examples 1-4 was tested. The offset was determined by visual inspection. The offset for Examples 1-11 and Comparative Examples 1 and 3-4 was "None" and no offsetting was observed. The offset for Comparative Example 2 was "NG" which means "No Good" and offsetting was observed. The offset for Comparative Example 5 was not conducted.

The bio-resins used in Examples 1-11 and Comparative Examples 1-5 were made in accordance with the methods described in US 2008/0145775 and US 2007/0015175, each of which is incorporated herein by reference in its entirety, using monomer mixtures that contained 2% by weight of trimethylol propane (TMP) as a cross-linking monomer, Floradyme 1100, Pripol 1013, and 1,4-cyclohexane dicarboxylic acid (CHDA) as di-acid monomer units; and isosorbide as the diol monomer unit. The mixture of monomer units was subjected to polymerization in the presence of a sodium acetate catalyst 0.02% by weight to form the bio-resins. The relative proportion of monomer units in the bio-resin HRJ16062-C was as follows (values are provided in weight % based on the total weight of the bio-resin): TMP 2%, CHDA 39.5%, Floradyme 1100 18%, isosorbide (98% pure) 39.5%, Pripol 1013 1%, by weight.

Softening point (Sp) was measured using a capillary rheometer flow tester (CFT-500, constant-pressure extrusion system, manufactured by Shimadzu Corporation of Japan) as a temperature at the middle point of a strand from the initiation to the completion of the flow when 1.0 g of a sample is measured by a flow tester (CFT-500, manufactured by Shimadzu Corporation of Japan) with a nozzle of 1 mm×10 mm (millimeters) under conditions such that the load is 30 kg (kilograms), the preheating time is 5 minutes at 50° C. (degrees Celsius) and the temperature raising rate is 3° C./min. Softening point was preferably measured with a precision of ±2° C. The softening points for each of the bio-toner formulations of Examples 1-11 and Comparative Examples 1-5, including the Sp for the resin 1 bio-resin and the Sp for the resin 2 petroleum, is shown in the table of FIG. 3A. The Sp for resin 1 bio-resin Examples 1 and 7-9 and Comparative Examples 1 and 5 was 133° C. The Sp for resin 1 bio-resin Examples 2 and 5-6 and Comparative Example 2 and 4 was 128° C. The Sp for resin 1 bio-resin Examples 3 and 10-11 was 135° C. The Sp for resin 1 bio-resin Example 4 and Comparative Example 3 was 140° C. The Sp for resin 2 petroleum-based resin Examples 1-9 and Comparative Example 5 was 127° C. The Sp for resin 2 petroleum-based resin Examples 10-11 was 99° C. The Sp for resin 2 petroleum-based resin Comparative Example 4 was 145° C. No resin 2 was used in Comparative Examples 1-3.

As can be seen from the results in the tables of FIG. 3A and FIG. 3B, resin compositions containing a mixture of bio-resin and petroleum-based resin provide the best overall performance. The preferred magnetic bio-toner composition or formulation, as shown in FIG. 3A and discussed above, is Example 11. It was believed that a combination of the wax or waxes and the second resin or resins selected had a bearing on the performance of the magnetic bio-toner composition.

Obviously, numerous modifications and variations of the disclosure are possible in light of the above teachings. It is therefore to be understood that within the scope of the appended claims, the disclosed embodiments may be practiced otherwise than as specifically described herein. Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The disclosure is not limited in its application to the details of the construction and to the arrangement of the components set forth in the disclosure or as shown in the drawings.

The invention claimed is:

1. A bio-toner comprising:

a bio-resin, a second resin, a wax, and one or more colorants;

wherein the bio-resin is a polyester polymer comprising one or more reacted di-acid monomer units and one or more reacted diol monomer units;

wherein at least one of the reacted di-acid monomer units or at least one of the reacted diol monomer units is a bio-monomer obtained from a plant or an animal source, wherein the wax has at least one peak temperature in a range of from about 60° C. to about 120° C. in a differential scanning calorimetry (DSC) measurement, and wherein the second resin is a polyester having a softening point of from 90 to 140° C. and comprises polymerized units of isophthalic acid, terephthalic acid, ethylene glycol and bisphenol-A.

2. The bio-toner of claim 1, wherein the bio-resin has a softening point in the range of from about 80 degrees Celsius to about 170 degrees Celsius.

3. The bio-toner of claim 1, wherein the bio-resin has a softening point in the range of from about 100 degrees Celsius to about 150 degrees Celsius.

4. The bio-toner of claim 1, wherein the bio-resin comprises reacted units of 1,4-cyclohexane dicarboxylic acid, a $C_{18}$ fatty acid dimerization product of one or more of oleic acid, linoleic acid, and linolenic acid, trimethylol propane, isosorbide, and a mixture thereof.

5. The bio-toner of claim 1, wherein the bio-resin contains reacted monomer units that are derived from soy beans or corn.

6. The bio-toner of claim 1, wherein at least 5 weight % of at least one of the diol monomer units or at least one of the di-acid monomer units are bio-monomers obtained from a plant or animal source, where weight % is based on the total weight % of the diol monomer units and the di-acid monomer units in the bio-resin.

7. The bio-toner of claim 1, wherein at least 5 weight % of at least one of the diol monomer units and at least one of the di-acid monomer units are bio-monomers obtained from a plant or animal source, where weight % is based on the total weight % of the diol monomer units and the di-acid monomer units in the bio-resin.

8. The bio-toner of claim 1, wherein the second resin is present in an amount of from about 1% by weight to about 50% by weight, wherein % by weight is based on the total weight of the bio-resin and the second resin.

9. The bio-toner of claim 1, wherein the one or more colorants is selected from the group comprising magnetite, carbon black, an acid dye, a color dye, a color pigment, a phthalocyanine colorant, and a mixture thereof.

10. The bio-toner of claim 1, further comprising more than about 30% by weight of a magnetic component, based on a total weight of the bio-toner.

11. The bio-toner of claim 10, wherein the bio-toner has a cobalt content of less than 50 parts per million by weight based on a total weight of the bio-toner.

12. The bio-toner of claim 1, further comprising a charge control agent selected from the group comprising an azo complex compound dye, salicylic acid, and an alkyl salicylic acid complex compound.

13. The bio-toner of claim 1, wherein the bio-toner shows at least one optical absorption peak in a wavelength range either between about 250 nanometers and about 350 nanometers or between about 450 nanometers and 650 nanometers, when dispersed in methanol (MeOH).

14. The bio-toner of claim 1, wherein the wax is at least one selected from the group consisting e of an ester-type wax and a hydrocarbon-type wax.

15. The bio-toner of claim 1, further comprising one or more additives selected from the group comprising silicon dioxide, aluminum oxide, titanium dioxide, and, silicon carbide.

16. The bio-toner of claim 1, further comprising at least one additive having a particle size of greater than 30 nanometers.

17. The bio-toner of claim 1, wherein the bio-toner has a D50 particle size in a range of from about 4 micrometers (μm) to about 11 micrometers (μm).

18. The bio-toner of claim 1, wherein a bio-based content of the bio-toner is at least 5% according to ASTM D6866-08.

19. A bio-toner, comprising:

a bio-resin, a second resin, a wax, and one or more colorants;

wherein the bio-resin is a polyester polymer comprising one or more reacted di-acid monomer units and one or more reacted diol monomer units;

wherein at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin, wherein the wax has at least one peak temperature in a range of from about 60° C. to about 120° C. in a differential scanning calorimetry (DSC) measurement, and wherein the second resin is a polyester having a softening point of from 90 to 140° C. and comprises polymerized units of isophthalic acid, terephthalic acid, ethylene glycol and bisphenol-A.

20. The bio-toner of claim 19, wherein the bio-resin has a softening point in the range of from about 100 degrees Celsius to about 150 degrees Celsius.

21. The bio-toner of claim 19, further comprising a charge control agent selected from the group comprising an azo complex compound dye, salicylic acid, and an alkyl salicylic acid complex compound.

22. The bio-toner of claim 19, wherein the bio-toner shows at least one optical absorption peak in a wavelength range either between about 250 nanometers and about 350 nanometers or between about 450 nanometers and 650 nanometers, when dispersed in methanol (MeOH).

23. The bio-toner of claim 19, further comprising one or more additives selected from the group comprising silicon dioxide, aluminum oxide, titanium dioxide, and, silicon carbide.

24. The bio-toner of claim 19, wherein a bio-based content of the bio-toner is at least 5% according to ASTM D6866-08.

25. The bio-toner of claim 19, wherein a bio-based content of the bio-toner is at least 30% according to ASTM D6866-08.

26. The bio-toner of claim 19, wherein the bio-resin and the second resin are present in a total amount of greater than 30% by weight, the wax is present in an amount of 10% or less by weight, and the one or more colorants is present in an amount of 60% or less by weight, wherein % by weight is based on the total weight of the bio-resin, the second resin, and the one or more colorants.

27. A bio-toner, comprising:

a bio-resin, a second resin, a wax, and one or more colorants;

wherein the bio-resin is a polyester polymer comprising reacted di-acid monomer units and reacted diol monomer units;

wherein at least 50 mol % of at least one of the diol monomer units and the di-acid monomer units are bio-monomers obtained from a plant or animal source, where mol % is based on the total number of mols of the diol monomer units or the di-acid monomer units, respectively, and wherein the wax has at least one peak temperature in a range of from about 60° C. to about 120° C. in a differential scanning calorimetry (DSC) measurement, and wherein the second resin is a polyester having a softening point of from 90 to 140° C. and comprises polymerized units of isophthalic acid, terephthalic acid, ethylene glycol and bisphenol-A.

28. The bio-toner of claim 27, wherein at least 50 mol % of the diol monomer units are bio-monomers obtained from a plant or animal source, based on the total number of reacted units of diol monomers in the bio-resin.

29. A bio-toner comprising:

a bio-resin, one or more colorants, and 0% to about 30% by weight of a magnetic component, based on a total weight of the bio-resin, the one or more colorants, and the magnetic component, if present;

wherein the bio-resin is a polyester polymer comprising one or more reacted di-acid monomer units and one or more reacted diol monomer units;

and further wherein at least one of the reacted di-acid monomer units or at least one of the reacted diol monomer units is a bio-monomer obtained from a plant or an animal source, wherein the wax has at least one peak temperature in a range of from about 60° C. to about 120° C. in a differential scanning calorimetry (DSC) measurement, and wherein the second resin is a polyester having a softening point of from 90 to 140° C. and comprises polymerized units of isophthalic acid, terephthalic acid, ethylene glycol and bisphenol-A.

30. The bio-toner of claim 29, wherein the bio-resin has a softening point in the range of from about 80 degrees Celsius to about 170 degrees Celsius.

31. The bio-toner of claim 29, wherein the bio-resin comprises reacted units of at least one of 1,4-cyclohexane dicarboxylic acid, a $C_{18}$ fatty acid dimerization product of one or more of oleic acid, linoleic acid, and linolenic acid, trimethylol propane, isosorbide, and a mixture thereof.

32. The bio-toner of claim 29, wherein the bio-resin comprises reacted units of isosorbide.

33. The bio-toner of claim 29, wherein the bio-resin comprises two reacted di-acid monomer units and one reacted diol monomer unit.

34. The bio-toner of claim 29, wherein the bio-resin contains reacted monomer units that are derived from soy beans or corn.

35. The bio-toner of claim 29, wherein at least 50 weight % of at least one of the diol monomer units or at least one of the di-acid monomer units are bio-monomers obtained from a plant or animal source, where weight % is based on the total weight % of the diol monomer units and the di-acid monomer units in the bio-resin.

36. The bio-toner of claim 29, wherein at least 50 weight % of at least one of the diol monomer units and at least one of the di-acid monomer units are bio-monomers obtained from a plant or animal source, where weight % is based on the total weight % of the diol monomer units and the di-acid monomer units in the bio-resin.

37. The bio-toner of claim 29, wherein at least about 5% by weight total of at least one of the di-acid monomer units or at least one of the diol monomer units are bio-monomers obtained from a plant or an animal source.

38. The bio-toner of claim 29, wherein at least about 5% by weight total of at least one of the di-acid monomer units and at least one of the diol monomer units are bio-monomers obtained from a plant or an animal source.

39. The bio-toner of claim 29, further comprising the second resin present in an amount of from about 1% by weight to about 50% by weight, wherein % by weight is based on the total weight of the bio-resin and the second resin.

40. The bio-toner of claim 29, wherein the one or more colorants is selected from the group comprising one or more of carbon black, an acid dye, a color dye, a color pigment, and a phthalocyanine colorant.

41. The bio-toner of claim 29, wherein the magnetic component is present in an amount of less than about 15% by weight based on a total weight of the bio-resin, one or more colorants, and the magnetic component, if present.

42. The bio-toner of claim 29, further comprising a charge control agent selected from the group comprising an azo complex compound dye, salicylic acid, and an alkyl salicylic acid complex compound.

43. The bio-toner of claim 29, wherein the bio-toner shows at least one optical absorption peak in a wavelength range either between about 250 nanometers and about 350 nanometers or between about 450 nanometers and 650 nanometers, when dispersed in methanol (MeOH).

44. The bio-toner of claim 29, wherein the wax is at least one selected from the group consisting of an ester-type wax and a hydrocarbon-type wax.

45. The bio-toner of claim 29, wherein the wax is present in an amount of from about 1% by weight to about 10% by weight, based on the total weight of the bio-resin, the second resin, the one or more colorants, and the wax.

46. The bio-toner of claim 29, further comprising one or more additives selected from the group comprising silicon dioxide, aluminum oxide, titanium dioxide, and silicon carbide.

47. The bio-toner of claim 29, further comprising at least one additive having a particle size greater than 30 nanometers.

48. The bio-toner of claim 29, wherein the bio-toner has a D50 particle size in a range of from about 4 micrometers (μm) to about 11 micrometers (μm).

49. The bio-toner of claim 29, wherein a bio-based content of the bio-toner is at least 5% according to ASTM D6866-08.

50. The bio-toner of claim 29, wherein the total amount of the bio-resin and the second resin is present in a total amount of greater than 80% by weight, the one or more colorants is present in an amount of 10% or less by weight, and the magnetic component is present in an amount of less than 10% by weight, wherein % by weight is based on the total weight of the bio-resin, the one or more colorants, and the magnetic component.

51. The bio-toner of claim 1, wherein the wax has at least one peak temperature in a range of from about 60° C. to about 71° C. in a differential scanning calorimetry measurement.

52. The bio-toner of claim 19, wherein the wax has at least one peak temperature in a range of from about 60° C. to about 71° C. in a differential scanning calorimetry measurement.

53. The bio-toner of claim 27, wherein the wax has at least one peak temperature in a range of from about 60° C. to about 71° C. in a differential scanning calorimetry measurement.

54. The bio-toner of claim 1, wherein the bio-resin does not include reacted isosorbide monomer units.

55. The bio-toner of claim 19, wherein the bio-resin does not include reacted isosorbide monomer units.

56. The bio-toner of claim 27, wherein the bio-resin does not include reacted isosorbide monomer units.

* * * * *